US010774438B2

(12) United States Patent
Thorum et al.

(10) Patent No.: US 10,774,438 B2
(45) **Date of Patent: *Sep. 15, 2020**

(54) MONITORING ELECTROLYTES DURING ELECTROPLATING

(71) Applicant: Lam Research Corporation, Fremont, CA (US)

(72) Inventors: Matthew Sherman Thorum, Boise, ID (US); Steven T. Mayer, Aurora, OR (US)

(73) Assignee: Lam Research Corporation, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/132,239

(22) Filed: Sep. 14, 2018

(65) Prior Publication Data

US 2019/0010626 A1 Jan. 10, 2019

Related U.S. Application Data

(63) Continuation of application No. 14/685,512, filed on Apr. 13, 2015, now Pat. No. 10,094,038.

(51) Int. Cl.

| | |
|---|---|
| ***C25D 21/12*** | (2006.01) |
| ***C25D 17/00*** | (2006.01) |
| ***C25D 7/12*** | (2006.01) |

(52) U.S. Cl.

CPC ..... *C25D 21/12* (2013.01); *C25D 7/12* (2013.01); *C25D 17/001* (2013.01)

(58) Field of Classification Search

CPC ..... C25D 21/12

See application file for complete search history.

(56) References Cited

U.S. PATENT DOCUMENTS

| | | | |
|---|---|---|---|
| 3,121,054 | A | 2/1964 | Emden |
| 4,479,852 | A | 10/1984 | Bindra et al. |
| 5,196,096 | A | 3/1993 | Chang et al. |
| 6,627,066 | B1 | 9/2003 | Isayama et al. |
| 6,740,221 | B2 | 5/2004 | Cheung et al. |
| 6,827,839 | B2 | 12/2004 | Sonnenberg et al. |
| 7,144,488 | B2 | 12/2006 | Binstead et al. |
| 7,449,098 | B1 | 11/2008 | Mayer et al. |
| 9,309,605 | B2 | 4/2016 | Mayer |

(Continued)

FOREIGN PATENT DOCUMENTS

| | | | |
|---|---|---|---|
| CN | 1186875 | A | 7/1998 |
| CN | 1379887 | A | 11/2002 |

(Continued)

OTHER PUBLICATIONS

Machine translation of CN103643284 of Tang et al. (Year: 2014).*

(Continued)

*Primary Examiner* — Brian W Cohen

(74) *Attorney, Agent, or Firm* — Weaver Austin Villeneuve & Sampson LLP

(57) ABSTRACT

Methods of and apparatuses for monitoring electroplating bath quality in electroplating cells using voltage readings are described herein. Methods involve obtaining real-time voltage readings during an electroplating process and determining whether the voltage readings are within a threshold deviation of an expected voltage reading at a given time.

16 Claims, 10 Drawing Sheets

(56) References Cited

U.S. PATENT DOCUMENTS

| | | | |
|---|---|---|---|
| 9,689,083 | B2 | 6/2017 | Brogan et al. |
| 10,094,038 | B2 | 10/2018 | Thorum et al. |
| 10,508,359 | B2 | 12/2019 | Brogan et al. |
| 2002/0060157 | A1 | 5/2002 | Calvert et al. |
| 2002/0074244 | A1 | 6/2002 | Sonnenberg et al. |
| 2003/0188977 | A1 | 10/2003 | Chalyt et al. |
| 2005/0247577 | A1 | 11/2005 | Pavlov et al. |
| 2007/0215490 | A1 | 9/2007 | Dow et al. |
| 2008/0264801 | A1 | 10/2008 | West et al. |
| 2009/0057151 | A1 | 3/2009 | Shalyt et al. |
| 2010/0032303 | A1 | 2/2010 | Reid et al. |
| 2011/0025294 | A1 | 2/2011 | Okubo et al. |
| 2011/0025338 | A1 | 2/2011 | Willey et al. |
| 2011/0266154 | A1 | 11/2011 | Pavlov et al. |
| 2013/0161203 | A1 | 6/2013 | Mayer |
| 2014/0367279 | A1 | 12/2014 | Brogan et al. |
| 2015/0203983 | A1 | 7/2015 | Tamari et al. |
| 2016/0186356 | A1 | 6/2016 | Mayer |
| 2016/0298256 | A1 | 10/2016 | Thorum et al. |
| 2017/0241041 | A1 | 8/2017 | Brogan et al. |

FOREIGN PATENT DOCUMENTS

| | | | | |
|---|---|---|---|---|
| CN | 101004402 | A | | 1/2006 |
| CN | 1764746 | A | | 4/2006 |
| CN | 1957115 | A | | 5/2007 |
| CN | 101004401 | A | | 7/2007 |
| CN | 102097347 | A | | 6/2011 |
| CN | 102471919 | A | | 5/2012 |
| CN | 103014823 | A | | 4/2013 |
| CN | 103035503 | A | | 4/2013 |
| CN | 103643284 | A | * | 3/2014 |
| JP | S59-137853 | | | 8/1984 |
| JP | H05-080028 | | | 3/1993 |
| JP | 7-180097 | A | | 7/1995 |
| JP | 2001-73183 | A | | 3/2001 |
| JP | 2001-73200 | A | | 3/2001 |
| JP | 2001-152398 | A | | 6/2001 |
| JP | 2001-303289 | | | 10/2001 |
| JP | 2002-195983 | A | | 7/2002 |
| JP | 2003-129298 | | | 5/2003 |
| JP | 2004-217997 | A | | 8/2004 |
| JP | 2004-323971 | | | 11/2004 |
| JP | 2005-148011 | A | | 6/2005 |
| JP | 2005-171347 | A | | 6/2005 |
| JP | 2009-299193 | | | 12/2009 |
| JP | 2009-299193 | A | | 12/2009 |
| JP | 2011-066447 | A | | 3/2011 |
| JP | 2015-134963 | A | | 7/2015 |
| KR | 10-2006-0074593 | | | 7/2006 |
| KR | 10-2007-0012525 | | | 1/2007 |
| TW | 201529905 | | | 8/2015 |
| WO | WO 01/18736 | A1 | | 3/2001 |
| WO | WO 03/0279779 | A2 | | 4/2003 |
| WO | WO 2011/017197 | A2 | | 2/2011 |
| WO | WO 2013/090295 | | | 6/2013 |

OTHER PUBLICATIONS

US Notice of Allowance, dated Mar. 1, 2017, issued in U.S. Appl. No. 14/275,750.
US Notice of Allowance, dated Apr. 7, 2017, issued in U.S. Appl. No. 14/275,750.
US Notice of Allowance, dated Apr. 17, 2017, issued in U.S. Appl. No. 14/275,750.
US Notice of Allowance, dated Dec. 15, 2015, issued in U.S. Appl. No. 13/711,254.
US Office Action, dated Mar. 6, 2017, issued in U.S. Appl. No. 15/061,833.
Chinese First Office Action dated Apr. 28, 2016 issued in CN 201410268283.8.
Chinese Second Office Action dated Jan. 20, 2017 issued in CN 201410268283.8.
PCT International Search Report and Written Opinion, dated Mar. 28, 2013, issued in PCT/US2012/069016.
PCT International Preliminary Report on Patentability and Written Opinion, dated Jun. 17, 2014, issued in PCT/US2012/069016.
Singapore Notice of Eligibility of Grant and Supplementary Examination Report dated Nov. 8, 2016 issued in SG 11201403033Y.
Japanese Notice of Reasons for Rejection dated Oct. 4, 2016 issued in JP 2014-547352.
Japanese Notice of Reasons for Rejection dated Apr. 24, 2018 issued in JP 2014-115335.
Taiwanese Office Action dated Dec. 27, 2017 issued in TW 103120592.
Japanese Notice of Reasons for Rejection dated Jul. 24, 2018 issued in JP 2017-130053.
US Final Office Action, dated Jul. 5, 2017, issued in U.S. Appl. No. 15/061,833.
US Notice of Allowance, dated Aug. 28, 2017, issued in U.S. Appl. No. 15/061,833.
US Office Action, dated Jul. 19, 2017, issued in U.S. Appl. No. 14/685,512.
US Final Office Action, dated Feb. 9, 2018, issued in U.S. Appl. No. 14/685,512.
US Notice of Allowance, dated May 21, 2018, issued in U.S. Appl. No. 14/685,512.
Chinese First Office Action dated Nov. 2, 2018 issued in CN 201710979575.6.
Chinese Second Office Action dated Aug. 2, 2019 issued in CN 201710979575.6.
Korean First Office Action dated Apr. 25, 2019 issued in KR 2014-7019507.
Korean Second Office Action dated Nov. 26, 2019 issued in KR 2014-7019507.
Taiwanese Office Action dated Feb. 4, 2020, issued in TW 105111169.
US Notice of Allowance, dated Apr. 19, 2019, issued in U.S. Appl. No. 15/590,718.
US Notice of Allowance, dated Aug. 13, 2019, issued in U.S. Appl. No. 15/590,718.
US Corrected Notice of Allowance, dated Nov. 20, 2019, issued in U.S. Appl. No. 15/590,718.
Japanese First Office Action dated Jun. 2, 2020, issued in JP 2016-079268.

* cited by examiner

Fault Range

Good Bath (0.52Å, 90 min)

Bad Bath (0.52Å, 90 min)

Expected Voltage

MONITORING ELECTROLYTES DURING ELECTROPLATING

CROSS-REFERENCE TO RELATED APPLICATION

This application is a continuation of U.S. patent application Ser. No. 14/685,512, filed Apr. 13, 2015, and titled "MONITORING ELECTROLYTES DURING ELECTROPLATING," which is incorporated by reference herein in its entirety and for all purposes.

BACKGROUND

Electrochemical deposition is used for sophisticated packaging and multichip interconnection technologies known generally as through silicon via (TSV) and wafer level packaging (WLP) electrical connection technology. These technologies present significant challenges.

Generally, the processes of creating TSVs are loosely akin to damascene processing but are conducted on recessed features that are larger and have higher aspect ratios. In TSV processing, a cavity or a recess is first etched into a substrate (e.g. a silicon wafer); next a dielectric liner may be formed on both the internal surface of the recessed feature and the field region of the substrate; then both the internal surface of the recessed feature and the field region of the substrate are metallized with a diffusion barrier and/or adhesion layer (e.g. Ta, Ti, TiW, TiN, TaN, Ru, Co, Ni, W), and an "electroplateable seed layer" (e.g. Cu, Ru, Ni, Co, that can be deposited, for example, by physical vapor deposition (PVD), chemical vapor deposition (CVD), atomic layer deposition (ALD), or electroless plating processes). Next, the metallized recessed features are filled with metal using, for example, "bottom up" copper electroplating. Note that the dielectric liner may not be deposited for substrates that are not electrically conductive such as for a glass, sapphire, or polymer substrate.

In contrast, through resist WLP feature formation typically proceeds differently. The process typically starts with a substantially planar substrate that may include some low aspect ratio vias or pads. The substantially planar dielectric substrate is coated with an adhesion layer followed by a seed layer (typically deposited by PVD). Then a photoresist layer is deposited and patterned over the seed layer to create a pattern of open areas in which the seed layer is exposed. Next, metal is electroplated into the open areas to form a pillar, line, or another feature on the substrate, which, after stripping the photoresist, and removing the seed layer by etching, leaves various electrically isolated embossed structures over the substrate.

Both of these technologies (TSV and through resist plating) require electroplating on a significantly larger size scale than damascene applications. Depending on the type and application of the packaging features (e.g. through chip connecting TSV, interconnection redistribution wiring, or chip to board or chip bonding, such as flip-chip pillars), plated features are often greater than about 2 micrometers in diameter and may be about 5 to about 100 micrometers in diameter (for example, pillars may be about 50 micrometers in diameter). For some on-chip structures such as power busses, the feature to be plated may be larger than 100 micrometers. The aspect ratios of the through resist WLP features are typically about 2:1 (height to width) or lower, more typically 1:1 or lower, while TSV structures can have very high aspect ratios (e.g., about 10:1 or 20:1).

SUMMARY

Methods and apparatuses for testing electroplating bath quality by monitoring voltage reading from an electroplating power supply during the electrofill process are provided. Some aspects involve methods of controlling an electroplating cell by monitoring the voltage, monitoring conditions of an electroplating bath, and/or monitoring conditions of the electroplating cell hardware over the course of the plating process for an individual wafer.

One aspect involves a method of controlling an electroplating cell by monitoring conditions of an electroplating bath, the method including: (a) reading an initial voltage between a substrate as a first electrode and a second electrode; (b) during electroplating on the substrate in the electroplating cell, repeatedly reading a voltage between the substrate and the second electrode; (c) comparing each of the repeated readings of the voltage to a corresponding expected voltage that drifts from the initial voltage during the electroplating, where the drift is determined from substrate electroplating operations that produce satisfactory electroplating results; (d) determining that one or more of the repeated readings of the voltage deviate from the corresponding expected voltage by a value greater than a threshold deviation; and (e) in response to determining that the one or more of the repeated readings of the voltage deviate from the corresponding expected voltage by a value greater than the threshold deviation, sending a notification and/or suspending operation of the electroplating cell. In some embodiments, (e) comprises placing the electroplating cell in an error state. In some embodiments, in (e), the electroplating cell is placed in an error state to prevent further automated processing of additional substrates in the potentially-unsatisfactory plating bath or through malfunctioning hardware. In some embodiments, placing the electroplating cell in an error state in (e) comprises placing the particular electroplating cell and all associated plating cell using the same bath that the threshold was exceeded into an error state.

In various embodiments, the second electrode is an anode counter electrode. In some embodiments, the second electrode is an auxiliary secondary anode (e.g. used and operated separately from a "main" anode for on-wafer uniformity manipulation). In some embodiments, the second electrode is a reference electrode in proximity to the substrate. The electroplating cell may be coupled to a power source configured to make the repeated readings of voltage between the substrate and the second electrode.

The substrate may include recessed features, and the electroplating on the substrate may include depositing a metal layer on the substrate in a manner that preferentially fills the recessed features. The recessed features may be vias in a through silicon via structure on the substrate. The recessed features may be damascene vias and/or lines. The recessed features may be lines or vias in a through photoresist pattern. The electroplating bath may include additives to preferentially fill the recessed features.

In various embodiments, all of one or more of the repeated readings of the voltage are read while applying a constant current between the substrate and the second electrode. The one or more of the repeated readings of the voltage may be the only voltage readings used to determine whether the electroplating cell is placed in an error state in (e). In some embodiments, placing the electroplating cell in an error state is determined only in response to determining that the one or more repeated readings of the voltage deviate from the corresponding expected voltage by a value greater than the threshold deviation in (e). The magnitudes of the repeated readings may not be used to determine whether the electroplating cell is placed in an error state in (e). In some embodiments where voltage instead of current is the process control parameter, readings of the current response are monitored in substantially the same manner as described elsewhere herein.

In some embodiments, the methods also include, after beginning to apply a constant current, waiting a delay period before repeatedly reading the voltage between the substrate and the second electrode.

The method may also include: determining the corresponding expected voltage by adding the initial voltage to a drift parameter that varies during the electroplating, where the initial voltage between the substrate and the second electrode is read before repeatedly reading the voltage between the substrate and the second electrode, where the drift parameter is independent of the total magnitude of the repeated readings of voltage between the substrate and the second electrode, and where the drift parameter corresponds to the drift determined from substrate electroplating operations that produce satisfactory electroplating results.

In various embodiments, the method may also include normalizing the initial voltage when comparing each of the repeated readings of the voltage to the corresponding expected voltage that drifts from the initial voltage during electroplating, where the initial voltage between the substrate and the second electrode is read before repeatedly reading the voltage between the substrate and the second electrode. The normalizing may include subtracting the initial voltage from the repeated readings of voltage before comparing the repeated readings of voltage to the corresponding expected voltages.

In some embodiments, the drift is a linear function of time. In some embodiments, the drift is a logarithmic function of time. The drift may include a three-part drift profile during the electroplating, such that the profile includes (i) a gradual reduction in voltage, and (ii) a rapid increase in voltage, and (iii) a period of stable voltage. In various embodiments, the substrate includes recessed features, and the rapid increase in (ii) occurs shortly before the features are completely filled. The threshold deviation may depend on the drift profile and may include one or more threshold deviations, and where a threshold deviation corresponding to (ii) is greater than a threshold deviation corresponding to (i).

In various embodiments, the electroplating includes one or more steps of electroplating, and a constant current is applied in each of the one or more steps. The current of a step may be the same as or different from the current of the immediately preceding step.

In some embodiments, the expected voltage drift includes linear fragments modeled from voltage readings obtained for one or more substrates determined to have the satisfactory electroplating results. The expected voltage may include normalized and averaged voltage readings for one or more substrates determined to have the satisfactory electroplating results.

In various embodiments, comparing each of the repeated readings of the voltage to a corresponding expected voltage that drifts from the initial voltage during the electroplating includes taking one or more derivatives of the repeated readings of the voltage and comparing said derivatives to one or more averaged derivatives of corresponding voltage readings for one or more substrates determined to have the satisfactory electroplating results.

Another aspect may include an apparatus for monitoring conditions of a plating solution during electroplating of a substrate including one or more recessed features, the apparatus including: (a) a plating vessel configured to hold the plating solution, where the apparatus is configured for electrodepositing a metal from the plating solution onto the substrate; (b) a power supply; (c) an electrode; (d) a controller including program instructions and/or logic for: (i) detecting an initial voltage between the substrate and the electrode; (ii) electroplating a metal layer on the substrate in the plating solution; (iii) repeatedly reading a voltage between the substrate and the electrode during (ii); (iv) determining whether voltage reading in (iii) is greater than a corresponding expected voltage by a value greater than a threshold deviation; and (v) in response to determining that the deviation in (iv) is greater than the threshold deviation, sending a notification and/or suspending operation of the plating vessel, where the threshold deviation is based on an expected voltage, where the corresponding expected voltage drifts from the initial voltage, and where the drift was determined from voltage readings in an electroplating process that produced satisfactory electroplating results.

In some embodiments, sending the notification and/or suspending the operation of the plating vessel includes placing the plating vessel in an error state.

In various embodiments the expected voltage drift includes linear fragments modeled from voltage readings obtained for one or more substrates determined to have the satisfactory electroplating results.

The expected voltage may include normalized and averaged voltage readings for one or more substrates determined to have the satisfactory electroplating results.

In some embodiments, determining whether voltage reading in (iii) is greater than the corresponding expected voltage by a value greater than the threshold deviation includes taking one or more derivatives of the repeated voltage readings and comparing said derivatives to one or more averaged derivatives of corresponding voltage readings for one or more substrates determined to have the satisfactory electroplating results.

These and other aspects are described further below with reference to the drawings.

DETAILED DESCRIPTION

Figure 1:
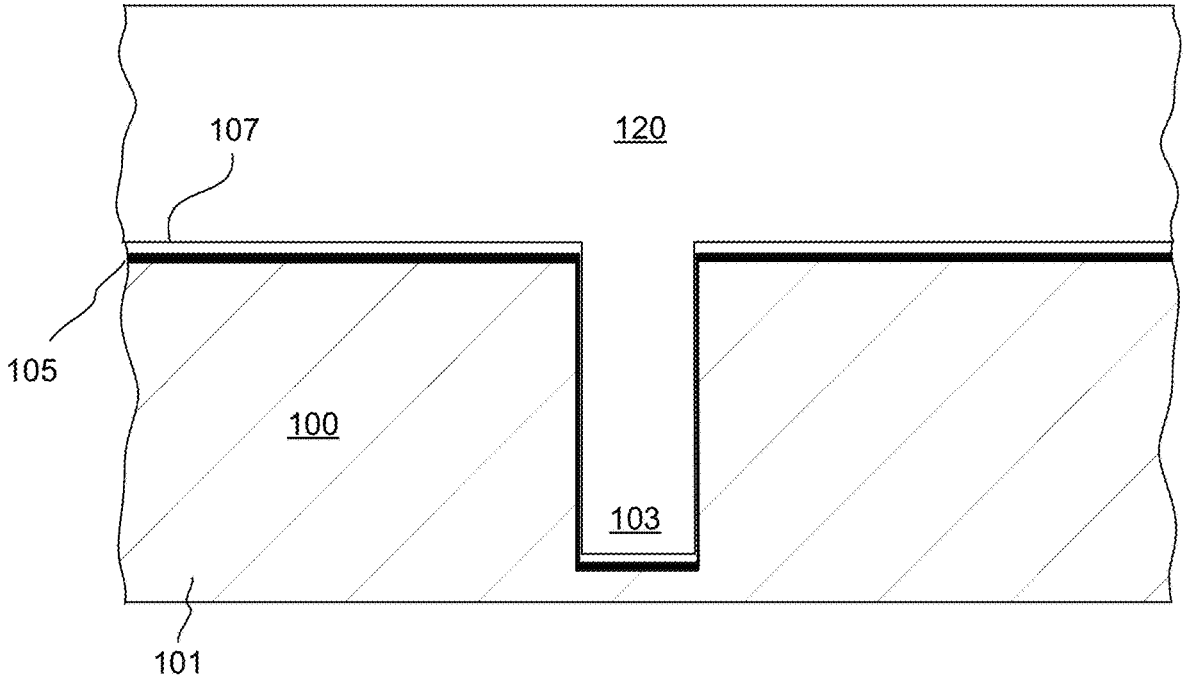
FIG. 1 is a schematic representation of a cross-section of a substrate having a TSV in contact with an electroplating solution.

In the following description, numerous specific details are set forth to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

Damascene processing is a method for forming metal lines on integrated circuits. Through-Silicon-Vias (TSVs) are sometimes used in conjunction with Damascene processing to create three-dimensional (3D) packages and 3D integrated circuits by providing interconnection of vertically aligned electronic devices through internal wiring. Such 3D packages and 3D integrated circuits may significantly reduce the complexity and overall dimensions of a multichip electronic circuit. Conductive routes on the surface of an integrated circuit formed during Damascene processing or in TSVs are commonly filled with copper.

A TSV is a via for an electrical connection passing completely through a semiconductor work piece, such as a silicon wafer or die. In this disclosure, various terms are used to describe a semiconductor work piece. For example, "wafer" and "substrate" are used interchangeably. A typical TSV process involves forming TSV holes and depositing a conformal diffusion barrier and conductive seed layers on a substrate, followed by filling of the TSV holes with a metal. TSV holes typically have high aspect ratios which makes void-free deposition of copper into such structures a challenging task. TSVs typically have aspect ratios of 5:1 and greater, such as 10:1 and greater, and even 20:1 and greater (e.g., reaching about 30:1), with widths at opening of about 0.1 μm or greater, such as about 5 μm or greater, and depths of about 5 μm or greater, such as about 50 μm or greater, and about 100 μm or greater. Examples of TSVs include 5×50 μm and 10×100 μm features. Such large recessed features, when coated with acid-sensitive seed layers are particularly difficult to fill using conventional techniques. Chemical vapor deposition (CVD) of copper requires complex and expensive precursors, while physical vapor deposition (PVD) often results in voids and limited step coverage. The process of depositing, or plating, metal onto a conductive surface via an electrochemical reaction is referred to generally as electroplating, plating, or electrofilling. Electroplating is a more common method of depositing copper into TSV structures; however, electroplating also presents a set of challenges because of the TSV's large size and high aspect ratio. Copper is typically used as the conductive metal in TSV fill as it supports the high current densities experienced at complex integration, such as for 3D packages and 3D integrated circuits. Copper also supports high device speeds. Furthermore, copper has good thermal conductivity and is available in a highly pure state.

Copper-containing metal as discussed herein is referred to as "copper" which includes without limitation, pure copper metal, copper alloys with other metals, and copper metal impregnated with non-metallic species, such as with organic and inorganic compounds used during electrofill operations (e.g., levelers, accelerators, suppressors, surface-active agents, etc.).

While electroplating processes will be primarily described making reference to copper plating and more particularly TSV copper damascene plating, it is understood that the methods provided herein and associated apparatus configurations can be used to perform plating of other metals and alloys, such as Au, Ag, Ni, Ru, Pd, Sn, In, and alloys of any of these such as Sn/Ag or Sn/In alloy, etc., and for through resist plating. The plating electrolytes will include a source of required metal ions (metal salt), and typically an acid in order to increase electrolyte conductivity.

The disclosed methods and apparatus can be used for electroplating a variety of recessed features, but are particularly advantageous for filling TSVs, which are recessed features that have relatively large sizes and high aspect ratios. In some embodiments, the recessed features may be damascene vias and/or lines. The recessed features may be lines or vias in a through photoresist pattern.

FIG. 1 illustrates a distribution of plating solution components when a substrate 100, having a recessed feature or via 103, contacts the plating solution 120. A cross-sectional schematic view of the substrate 100 is shown. The substrate 100 includes a layer of silicon 101, and a via 103 etched into the silicon 101. A dielectric liner (not shown) may be deposited on the silicon 101 in some embodiments. A diffusion barrier layer 105, such as a W/WN bi-layer resides on the layer of dielectric. A seed layer 107, such as a copper or nickel seed layer, resides on top of the barrier layer 105, and is exposed to the electroplating solution 120. In some embodiments, a conformal film stack may be present on the substrate. The electroplating solution 120 contains a metal salt, an acid, and additives such as an accelerator, and a suppressor. As shown in FIG. 1, in a typical TSV electrofilling process, a substrate 100 is negatively electrically biased and is contacted with a plating solution 120 in a plating bath which generally includes a metal salt such as copper sulfate or copper methane sulfonate as a source of copper ions, an acid, such as sulfuric acid or methane sulfonic acid for controlling conductivity, along with additives such as chloride ions and organic additives in various functional classes, known as, suppressors, accelerators and levelers.

Additives

Electroplating for TSV applications and in some cases, WLP applications, may be performed with low current to avoid formation of pinch off voids and to accommodate the diffusion of copper in high aspect ratio features. Additives may be included in the electroplating solution to enable bottom-up fill of features by altering the behavior of the electroplating solution on the substrate. Example additives include suppressors, accelerators, and levelers. In some embodiments, the suppressor acts as both a suppressor and a leveler (e.g., a suppressor may have "leveling character"). An example additive package may include 60 g/L Cu, 60 g/L sulfuric acid, and 50 ppm chloride with HSL-A accelerator and HSL-B suppressor, which is available from Moses Lake Industries of Moses Lake, Wash.

During electroplating, changes in additives on the wafer surface may cause voltage drift in constant current electroplating steps. For example, without being bound by a particular theory, it is believed that the surface concentration of suppressor adsorbed on the wafer surface decreases over time as it is displaced by the adsorption of accelerator, thereby decreasing polarization and decreasing the voltage between electrodes. Locally high surface concentration of adsorbed accelerator at the bottom of the vias leads to an increased plating rate in the vias and bottom-up fill. When vias approach nearly complete fill, the local accelerating effect decreases—partly due to the suppressor and/or leveler displacing the accelerator in the vias—and polarization increases. This decrease in the accelerator activity reduces the formation of large bumps over the vias and is generally referred to as "leveling." The suppressors used herein may have leveling character.

Suppressors

While not wishing to be bound to any theory or mechanism of action, it is believed that suppressors (either alone or in combination with other bath additives) are surface polarizing compounds that lead to a significant increase in the voltage drop across the substrate-electrolyte interface, especially when present in combination with a surface chemisorbing halide (e.g., chloride or bromide). The halide may act as a chemisorbed-bridge between the suppressor molecules and the substrate surface. The suppressor both (1) increases the local polarization of the substrate surface at regions where the suppressor is present relative to regions where the suppressor is absent, and (2) increases the polarization of the substrate surface generally. The increased polarization (local and/or general) corresponds to increased resistivity/impedance and therefore slower plating at a particular applied potential.

It is believed that suppressors are not significantly incorporated into the deposited film, though they may slowly degrade over time by electrolysis or chemical decomposition in the bath. Suppressors are often relatively large molecules, and in many instances they are polymeric in nature (e.g., polyethylene oxide, polypropylene oxide, polyethylene glycol, polypropylene glycol, etc). Other examples of suppressors include polyethylene and polypropylene oxides with S- and/or N-containing functional groups, block polymers of polyethylene oxide and polypropylene oxides, etc. The suppressors can have linear chain structures or branch structures or both. It is common that suppressor molecules with various molecular weights co-exist in a commercial suppressor solution. Due in part to suppressors' large size, the diffusion of these compounds into a recessed feature can be relatively slow compared to other bath components.

Some suppressors include leveling character. Although a leveler may be used in conjunction with a suppressor and/or accelerator, some suppressors may include leveling behavior sufficient for disclosed embodiments.

While not wishing to be bound by any theory or mechanism of action, it is believed that levelers (either alone or in combination with other bath additives) act as suppressing agents, in some cases to counteract the depolarization effect associated with accelerators, especially in exposed portions of a substrate, such as the field region of a substrate being processed, and at the side walls of a feature. The leveler may locally increase the polarization/surface resistance of the substrate, thereby slowing the local electrodeposition reaction in regions where the leveler is present. The local concentration of levelers is determined to some degree by mass transport. Therefore levelers act principally on surface structures having geometries that protrude away from the surface. This action "smooths" the surface of the electrodeposited layer. It is believed that in many cases the leveler reacts or is consumed at the substrate surface at a rate that is at or near a diffusion limited rate, and therefore, a continuous supply of leveler is often beneficial in maintaining uniform plating conditions over time.

Leveler compounds are generally classified as levelers based on their electrochemical function and impact and do not require specific chemical structure or formulation. However, levelers often contain one or more nitrogen, amine, imide, or imidazole, and may also contain sulfur functional groups. Certain levelers include one or more five- and six-member rings and/or conjugated organic compound derivatives. Nitrogen groups may form part of the ring structure. In amine-containing levelers, the amines may be primary, secondary, or tertiary alkyl amines. Furthermore, the amine may be an aryl amine or a heterocyclic amine. Example amines include, but are not limited to, dialkylamines, trialkylamines, arylalkylamines, triazoles, imidazole, triazole, tetrazole, benzimidazole, benzotriazole, piperidine, morpholines, piperazine, pyridine, oxazole, benzoxazole, pyrimidine, quonoline, and isoquinoline. Imidazole and pyridine may be especially useful. An example of a leveler is Janus Green B. Leveler compounds may also include ethoxide groups. For example, the leveler may include a general backbone similar to that found in polyethylene glycol or polyethyelene oxide, with fragments of amine functionally inserted over the chain (e.g., Janus Green B). Example epoxides include, but are not limited to, epihalohydrins such as epichlorohydrin and epibromohydrin, and polyepoxide compounds. Polyepoxide compounds having two or more epoxide moieties joined together by an ether-containing linkage may be especially useful. Some leveler compounds are polymeric, while others are not. Example polymeric leveler compounds include, but are not limited to, polyethylenimine, polyamidoamines, and reaction products of an amine with various oxygen epoxides or sulfides. One example of a non-polymeric leveler is 6-mercapto-hexanol. Another example leveler is polyvinylpyrrolidone (PVP).

Accelerators

While not wishing to be bound by any theory or mechanism of action, it is believed that accelerators (either alone or in combination with other bath additives) tend to locally reduce the polarization effect associated with the presence of suppressors, and thereby locally increase the electrodeposition rate. The reduced polarization effect is most pronounced in regions where the adsorbed accelerator is most concentrated (i.e., the polarization is reduced as a function of the local surface concentration of adsorbed accelerator). Example accelerators include, but are not limited to, dimercaptopropane sulfonic acid, dimercaptoethane sulfonic acid, mercaptopropane sulfonic acid, mercaptoethane sulfonic acid, bis-(3-sulfopropyl) disulfide (SPS), and their derivatives. Although the accelerator may become strongly adsorbed to the substrate surface and generally laterally-surface immobile as a result of the plating reactions, the accelerator is generally not significantly incorporated into the film. Thus, the accelerator remains on the surface as metal is deposited. As a recess is filled, the local accelerator concentration increases on the surface within the recess. Accelerators tend to be smaller molecules and exhibit faster diffusion into recessed features, as compared to suppressors.

Bottom-Up Fill

In the bottom-up fill mechanism, a recessed feature on a plating surface tends to be plated with metal from the bottom to the top of the feature, and inward from the sidewalls towards the center of the feature. The deposition rate may be controlled within the feature and in the field region to achieve uniform filling and avoid incorporating voids into the features. The three types of additives described above are beneficial in accomplishing bottom-up fill, each working to selectively increase or decrease the polarization at the substrate surface.

In the later stages of plating, particularly as overburden deposits, the accelerator may build up in certain regions (e.g., above filled features) undesirably, resulting in local faster-than-desired plating. Levelers may be used to counteract this effect. Without leveler, a feature may tend to overfill and produce a bump. Therefore, in the later stages of bottom-up fill plating, levelers are beneficial in producing a relatively flat deposit.

The use of suppressor, accelerator, and leveler, in combination, may allow a feature to be filled without voids from the bottom-up and from the sidewalls-inward, while producing a relatively flat deposited surface. The exact identity/composition of the additive compounds are typically maintained as trade secrets by the additive suppliers, thus, information about the exact nature of these compounds is not publicly available.

Monitoring Plating Baths

The concentration of these plating bath components typically changes over the course of processing as the components are incorporated into the plated substrate, degrade over time, etc. The rate and severity of the degradation can vary unpredictably. As such, in order to achieve consistently satisfactory fill results, it is necessary to monitor the composition of the bath over time. In this way, when the concentration of a plating bath additive is found to be too low, for example, appropriate steps can be taken to increase the concentration of that additive in the bath.

Widely used conventional methods for monitoring plating baths typically utilize scanning voltammetric coulometry, electrochemical titrations, spectroscopic methods (e.g., visible, IR and UV solution analysis), and various forms of HPLC to independently attempt to evaluate the concentration of various known bath components (e.g., metal, acid, and each additive) at concentrations close to the target operating concentrations. For example, in the voltammetric coulometry method, a platinum rotating disk electrode (RDE) is used as a working electrode. A signal is generated by integrating the charge passed during the anodic stripping wave of a cyclic voltammogram. Typically, a series of similar experiments are performed where the concentration of a target species in solution is modified. The solution will generally be largely insensitive to the concentration of other (non-target) bath species.

Robust control over the quality of the filling process within an individual substrate and over the course of plating multiple substrates on a plating tool is desired. Such method may indicate whether a particular plating cell will (or will not) meet a defined electroplating specification (e.g., produce a successful bottom-up fill), and yet not rely on the specifics of any particular additive constituent, additive concentration or compositions, and not require individually testing for the presence of different species. The disclosed techniques can be performed without knowledge of the identity of the specific species that may be present in the solution. The process may also be sensitive to byproducts or contaminants that are dilute and not detected by conventional methods. For example, in conventional methods, although measured additive concentrations fall within specifications, bath performance may still be poor due to undetected contamination.

Provided herein are methods and apparatus for monitoring the quality of an electroplating bath during electroplating. Some disclosed embodiments may be implemented on electroplating apparatuses without replacing or changing existing hardware. For example, processes in accordance with disclosed embodiments may be programmed into a controller configured to control operations of an electroplating apparatus such as supplying electrical current to the substrate and anode.

Figure 2:
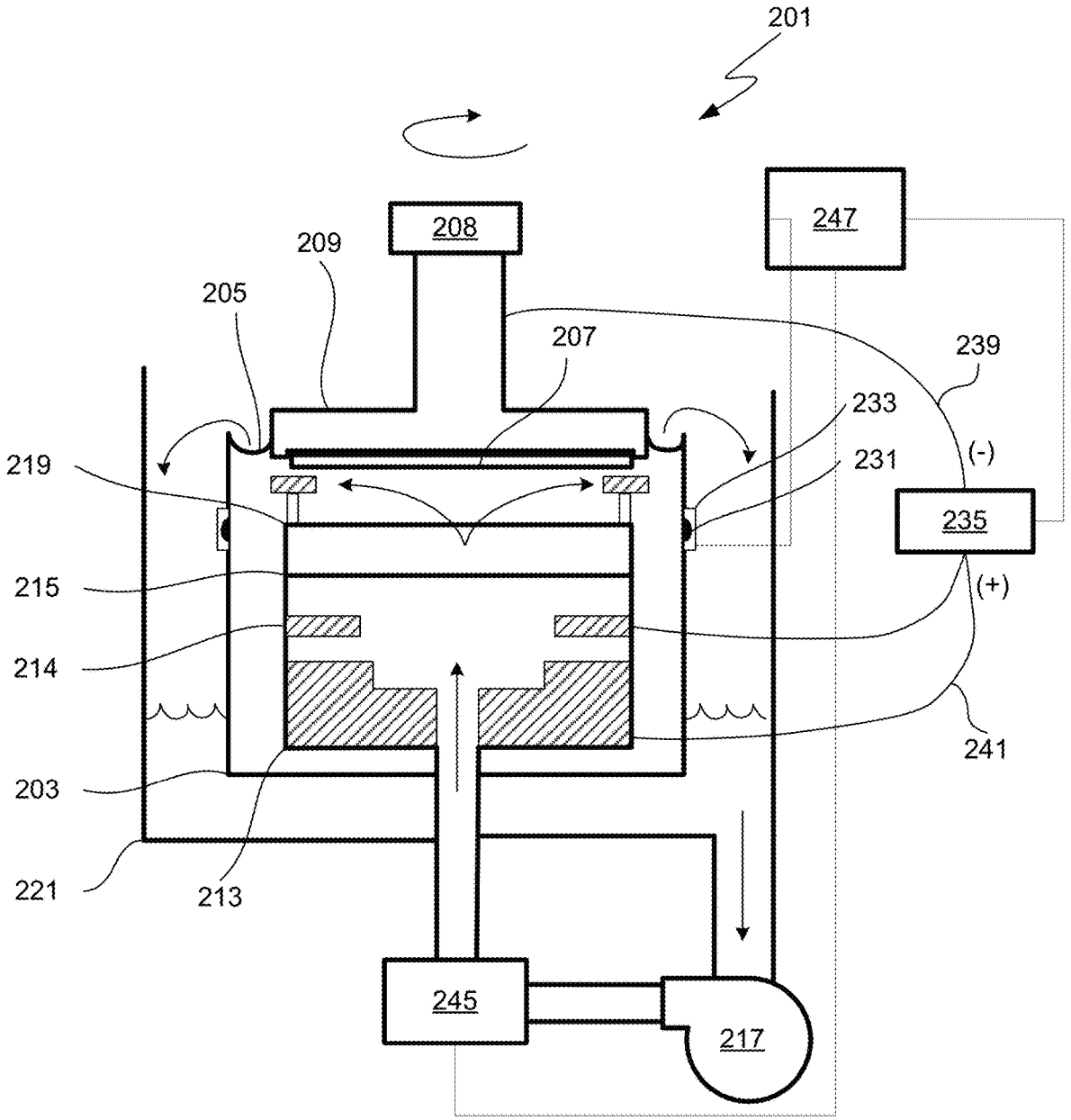
FIG. 2 is a simplified schematic presentation of an electroplating apparatus suitable for filling recessed features in accordance with disclosed embodiments.

Electroplating processes as described herein may include additives in the electrolyte to optimize bottom-up fill. However, an electrolyte with additives may react with the anode in undesirable ways. Therefore anodic and cathodic regions of the plating cell are sometimes separated by a membrane so that plating solutions of different composition may be used in each region. Plating solution in the cathodic region is called catholyte; and in the anodic region, anolyte. A number of engineering designs can be used in order to introduce anolyte and catholyte into the plating apparatus. An example apparatus for electroplating substrates is illustrated in FIG. 2. The apparatus includes one or more electroplating cells in which the substrates are processed. One electroplating cell is shown in FIG. 2 to preserve clarity.

Referring to FIG. 2, a diagrammatical cross-sectional view of an electroplating apparatus 201 in accordance with one embodiment is shown. The plating bath 203 contains the plating solution (which may include accelerators, suppressors, and sometimes levelers), which is shown at a level 205. The catholyte portion of this vessel is adapted for receiving substrates in a catholyte. A substrate 207 is immersed into the plating solution and is held by, e.g., a "clamshell" holding fixture 209, mounted on a rotatable spindle 208, which allows rotation of clamshell 209 together with the substrate 207. A general description of a clamshell-type plating apparatus having aspects suitable for use disclosed embodiments is described in detail in U.S. Pat. No. 6,156,167 issued to Patton et al., and U.S. Pat. No. 6,800,187 issued to Reid et al, which are incorporated herein by reference for all purposes.

An anode 213 is disposed below the substrate within the plating bath 203 and is separated from the substrate region by a membrane 215, which may be an ion selective membrane. For example, Nafion™ cationic exchange membrane (CEM) may be used. The region below the anodic membrane 215 is often referred to as an "anode chamber." The ion-selective anode membrane 215 allows ionic communication between the anodic and cathodic regions of the plating cell, while preventing the particles generated at the anode from entering the proximity of the substrate and contaminating it. The anode membrane is also useful in redistributing current flow during the plating process and thereby improving the plating uniformity. Detailed descriptions of suitable anodic membranes are provided in U.S. Pat. Nos. 6,126,798 and 6,569,299 issued to Reid et al., both incorporated herein by reference for all purposes. Ion exchange membranes, such as cationic exchange membranes are especially suitable for these applications. These membranes are typically made of ionomeric materials, such as perfluorinated co-polymers containing sulfonic groups (e.g. Nafion™), sulfonated polyimides, and other materials suitable for cation exchange. Selected examples of suitable Nafion™ membranes include N324 and N424 membranes available from Dupont de Nemours Co.

During plating, the ions from the plating solution are deposited on the substrate. The metal ions diffuse through the diffusion boundary layer and into the TSV hole. A typical way to assist the diffusion is through convection flow of the electroplating solution provided by the pump 217. Additionally, a vibration agitation or sonic agitation member may be used as well as wafer rotation. For example, a vibration transducer 208 may be attached to the wafer chuck 209.

The plating solution is continuously provided to plating bath 203 by the pump 217. Generally, the plating solution flows upwards, as shown by the arrow, through an anode membrane 215 and a diffuser plate 219 to the center of substrate 207 and then radially outward and across substrate 207. The plating solution also may be provided into anodic region of the bath from the side of the plating bath 203. The plating solution then overflows plating bath 203 to an overflow reservoir 221. The plating solution is then filtered (not shown) and returned to pump 217 completing the recirculation of the plating solution. In certain configurations of the plating cell, a distinct electrolyte is circulated through the portion of the plating cell in which the anode is contained while mixing with the main plating solution is prevented using sparingly permeable membranes or ion selective membranes.

The apparatus may also include a heater 245 for maintaining the temperature of the plating solution at a specific level. The plating solution may be used to transfer the heat to the other elements of the plating bath 203. For example, when a substrate 207 is loaded into the plating bath 203, the heater 245 and the pump 217 may be turned on to circulate the plating solution through the electroplating apparatus 201, until the temperature throughout the apparatus 201 becomes substantially uniform. In one embodiment the heater 245 is connected to the system controller 247. The system controller 247 may be connected to a thermocouple to receive feedback of the plating solution temperature within the electroplating apparatus 201 and determine the need for additional heating.

In the depicted embodiment, a reference electrode 231 is located on the outside of the plating bath 203 in a separate chamber 233, which chamber is replenished by overflow from the main plating bath 203. Alternatively, in some embodiments the reference electrode is positioned as close to the substrate surface as possible such that it is in proximity to the substrate, and the reference electrode chamber is connected via a capillary tube or by another method, to the side of the wafer substrate or directly under the wafer substrate. In some of the preferred embodiments, the apparatus further includes contact sense leads that connect to the wafer periphery and which are configured to sense the potential of the metal seed layer at the periphery of the wafer but do not carry any current to the wafer.

The reference electrode 231 may be one of a variety of commonly used types such as mercury/mercury sulfate, silver chloride, saturated calomel, or copper metal. A contact sense lead in direct contact with the substrate 207 may be used in some embodiments, in addition to the reference electrode, for more accurate potential measurement (not shown).

A DC power supply 235 can be used to control current flowing to the substrate 207. The power supply 235 has a negative output lead 239 electrically connected to substrate 207 through one or more slip rings, brushes, and contacts (not shown). The positive output lead 241 of power supply 235 is electrically connected to an anode 213 located in plating bath 203. The power supply 235, a reference electrode 231, and a contact sense lead (not shown) can be connected to a system controller 247, which allows, among other functions, modulation of current and potential provided to the elements of electroplating cell. For example, the controller may allow electroplating in potential-controlled and current-controlled regimes, such as electroplating in one or more steps, each step being performed at a constant current. The controller may include program instructions specifying current and voltage levels that need to be applied to electrodes of the plating cell, as well as times at which these levels need to be changed. The controller may control current and calculate voltage as described in disclosed embodiments. When forward current is applied, the power supply 235 biases the substrate 207 to have a negative potential relative to anode 213. This causes an electrical current to flow from anode 213 to the substrate 207, and an electrochemical reduction (e.g. $Cu^{2+}+2\ e^{-}=Cu^{0}$) occurs on the substrate surface (the cathode), which results in the deposition of the electrically conductive layer (e.g. copper) on the surfaces of the substrate 207. An active or inert anode 214 may be installed below the substrate 207 within the plating bath 203 and separated from the wafer region by the membrane 215.

As explained, TSV electrofill processes are sensitive to certain electrolyte conditions that degrade fill performance and are not easily detected by currently available bath metrology. In many designs, such conditions can be discovered only when the fill process fails, at which point the previously plated substrates are scrapped. For example, the breakdown of a small amount of accelerator can produce products with incomplete fills. Further, the loss of certain moieties responsible for maintaining suppression over long time intervals can result in defective fills. The addition of trace amounts of leveler moieties can likewise result in defective TSV fills. Further, the presence of various unrecognized materials can lead to fill failure. Each of these problems can occur at concentration changes/levels that are not easily detectable by conventional methods. The TSV fill process is particularly sensitive to changes in the bath composition. In short, conventional metrology methods are unable to accurately predict whether a particular plating bath will produce an acceptable bottom-up fill result, and can lead to the production of sub-standard devices or even the complete loss of valuable substrates.

Provided herein are methods for determining whether an electroplating bath will produce an acceptable bottom-up fill result, and therefore determine whether to send a notification and/or suspend operation of the electroplating cell. For example, methods may determine whether to place an electroplating bath or electroplating cell in an "error state" or otherwise address an actual or potential bath problem. An electroplating cell placed in an error state may be prevented further automated processing of additional substrates in the potentially-unsatisfactory plating bath or through malfunctioning hardware. In some embodiments, placing the electroplating cell in an error state includes placing the particular electroplating cell and all associated plating cell using the same bath that the threshold was exceeded into an error state. Methods involve monitoring voltage readings from the plating power supply during the electrofill process to provide a "go/no go" test of the plating bath quality. A "go/no go" test is a test to determine whether the substrate should be plated in an electroplating bath (go) or should not be plated in the electroplating bath (no go).

As shown in FIG. 2, power supply 235 delivers controlled electrical power between the substrate 207 and a counter-electrode. When a substrate 207 is being electroplated, the substrate 207 may serve as the cathode while the counter-electrode serves as the anode 213. In some embodiments, the anode is an auxiliary secondary anode (e.g. used and operated separately from a "main" anode for on-wafer uniformity manipulation). Some disclosed embodiments may be performed in combination with a reference electrode to increase sensitivity by providing an additional measure of potential near the substrate surface. The power supply 235 reads voltage and/or current between the substrate 207 and the anode 213 to control the electrical power. These readings may be referred to herein as "voltage readings." The power supply 235 may include a built-in conventional voltage meter for reading voltage. The voltage readings are made between the contacts (or bus) for each of the two electrodes. In some embodiments, voltage readings may be read based on input from a "sense" lead. The power supply 235 may not account for losses in internal circuits but the voltage readings obtained are sufficient to supply the current output desired.

Software and/or control circuitry, such as the controller 247, controls delivered power to maintain the measured voltage, or a constant current within a defined specification. The power supply 235 may control the delivered current and/or voltage between the substrate 207 and the anode 213. In some implementations, the cell may include a reference electrode 231 and the power supply 235 monitors the potential difference between the substrate 207 and the reference electrode 231.

The voltage readings vary over the course of the plating process due to the variable polarization of the substrate in contact with the plating bath. Additionally, voltage readings can vary between identically configured cells operating in the same state. Two cells having identical electrolytes, substrates, cathodes, and geometries, and other features normally considered relevant to electroplating performance can have very different resistances. Variations in resistance can arise in the electronic portions of the circuit between the power supply and the electrodes. For example, resistance of brush contacts used for the rotating wafer chuck can vary from cell-to-cell, as can the resistance of the peripheral contacts that engage the substrate. At a constant current, such variations in resistance result in variations in voltage read at the power supply. Since steps performed in an electroplating process are performed at constant current, the voltage reading variation provides information about the state of the bath chemistry that can be used to determine if the bath is good enough to provide acceptable TSV gapfill performance. Although the voltage also depends on other factors that are not relevant to the quality of the bath chemistry (e.g. the applied current and the Ohmic resistance of the plating circuit), the deviation from a baseline voltage may be used to monitor the quality of the plating bath.

Note that variation in the resistance of the plating circuit and the variation in polarization of the wafer during the plating process operate on different time scales. For example, the Ohmic voltage drop during a constant current plating process is effectively constant and contributes essentially nothing to the voltage drift observed during electroplating. Any change in Ohmic voltage drop may be due to a change in plating current and/or gradual fluctuation of the resistance of the plating circuit, while the variation in polarization during a plating step is variable and is used to monitor the quality of the plating bath. Although the resistance of a plating circuit may gradually fluctuate over time, the fluctuations occur over long periods of time, such as months or years, and thus resistance can be treated as constant during a plating process.

Electroplating in degraded baths leads to an observable change in the voltage readings during the plating process. The variation in the voltage readings during plating can be subtle and methods and apparatuses provided herein determine the bath quality based on the voltage readings. Note in various embodiments, the magnitude of the voltage is not used to determine the quality of the plating bath.

In some electroplating tools, voltage monitoring may be based on the expected magnitude or the range of the voltage readings to verify that the tool hardware is functioning correctly and consistently. Existing methods are not capable of determining the quality of the bath reliably due to the convolution of the effects of the tool hardware and the bath chemistry on the voltage readings and due to the relative subtlety of the effects of bath quality on the voltage readings. In contrast with existing methods, the methods described herein may be configured to isolate the effects of the bath quality on the voltage readings and exclude the effects caused by the tool hardware.

Figure 3:
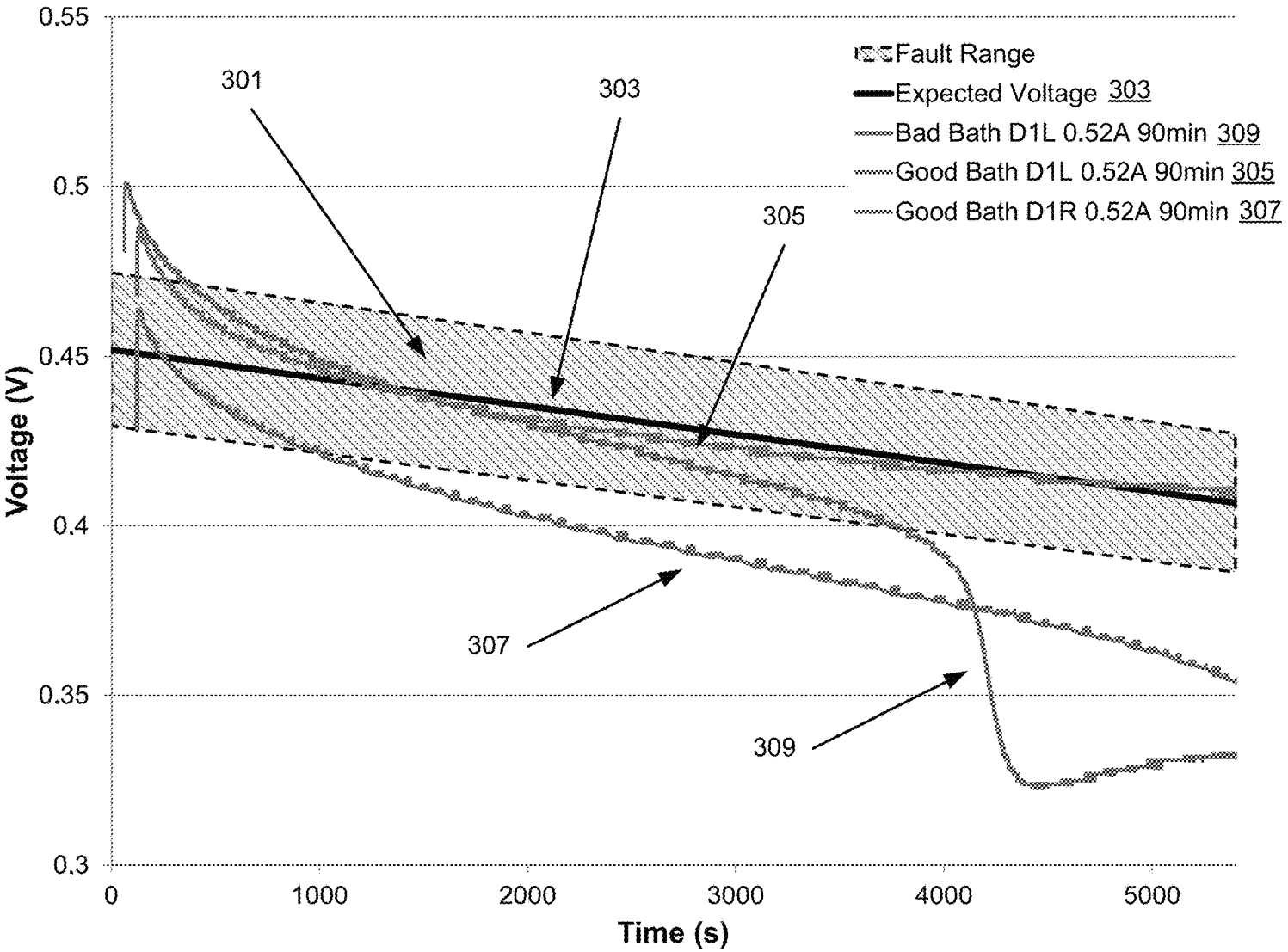
FIG. 3 is an example graph of voltage readings for various electroplating baths.

FIG. 3 is a graph depicting voltage readings versus time measured for three electroplating processes performed on a blanket wafer (nominally flat surface without features). Lines 305 and 307 show voltage readings for good baths in different cells. The voltage readings are different due to the difference in the total resistance of the two plating circuits; line 305 shows voltage readings from a cell with a higher resistance and the voltage readings are higher than the readings shown by line 307 that were obtained from a cell with lower resistance. Note that both of these cells were capable of good TSV fill and the variation between 305 and 307 is typical of the normal Ohmic resistance variation observed between cells. Line 309 shows voltage readings for a poor performing bath from the same cell as the readings shown by line 305. The deviation in the voltage reading that occurs after about 4000 sec of plating time is indicative of poor bath performance. Line 303 shows the expected voltage for the electroplating cell used to obtain lines 305 and 309. A simple cell monitoring technology might generate a fault band 301, whereby voltage readings out of the fault range (such as line 309) are flagged as being a poor electroplating bath, and voltage readings in the fault range are flagged as being good (such as line 305). Note, however, that although line 307 was obtained for a good bath, the system used in FIG. 3 would incorrectly flag 307 as being a poor bath. This is because the method used does not account for resistance differences between seemingly identical electroplating cells.

Figure 4A:
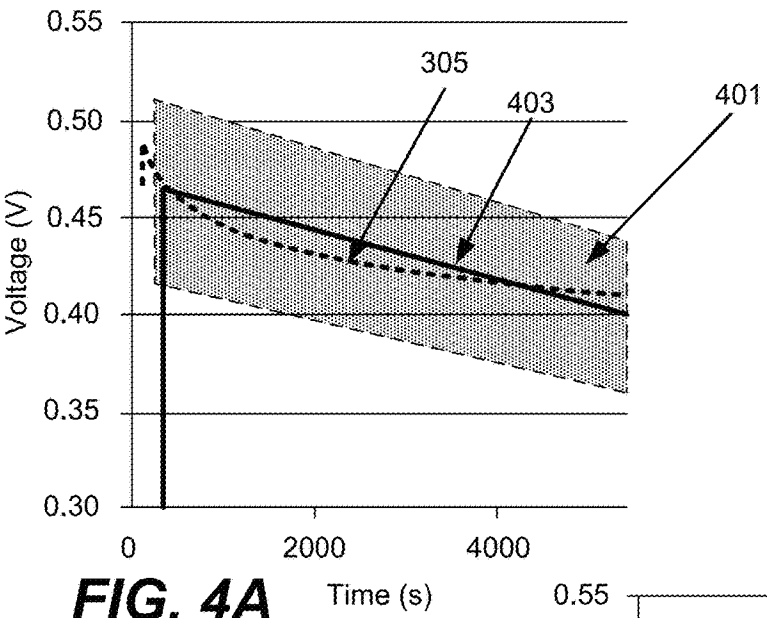
FIGS. 4A-4C are example graphs of voltage readings for electroplating baths and fault bands in accordance with disclosed embodiments.
Figure 4B:
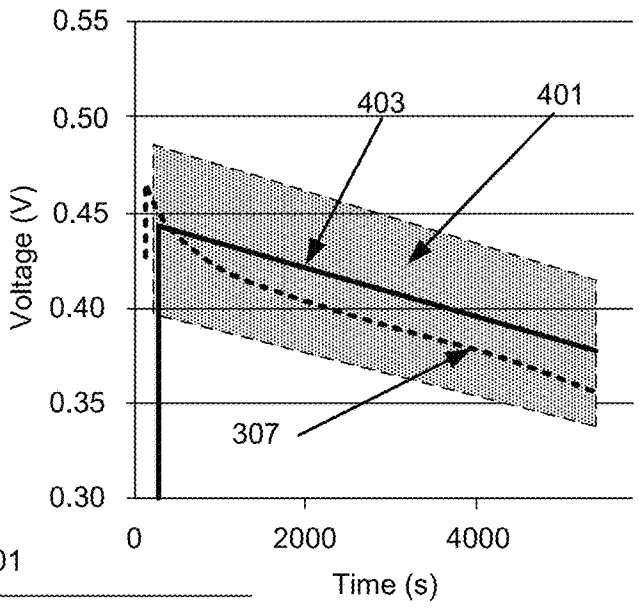
Figure 4C:
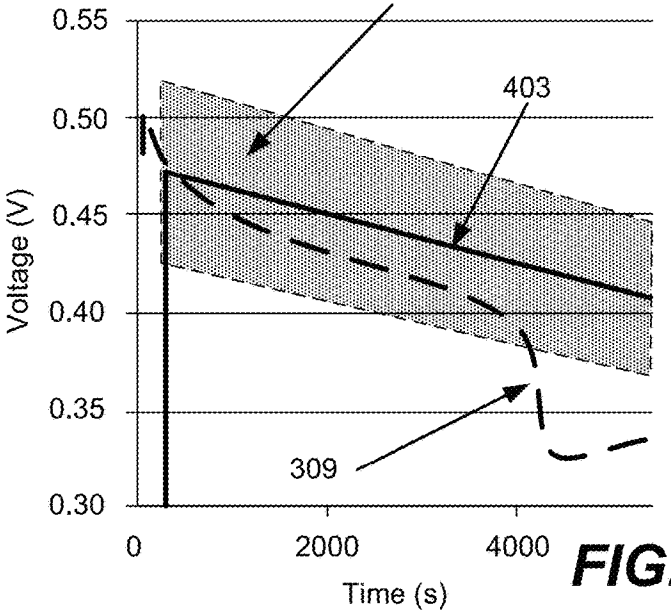

In contrast, FIGS. 4A, 4B, and 4C show the same three sets of voltage readings when evaluated using methods described herein, and in each case the fault bands 401 (based on expected voltage 403) accurately categorize the bath. FIG. 4A corresponds to line 305 of FIG. 3, and is detected as a good bath. FIG. 4B corresponds to line 307, which now accurately categorizes it as a good bath. FIG. 4C corresponds to line 309, which is detected as a poor bath. The approach described herein and represented in FIGS. 4A, 4B, and 4C employs a comparison between actual voltage readings and expected voltage readings in a manner that removes the effect of voltage magnitude differences from electroplating cell to electroplating cell.

The disclosed methods are based on the change in voltage readings that occur during the plating process and enable the user to set up an expected voltage profile that will be valid on any cell even if the magnitude of the voltage varies widely between cells. An expected voltage profile is defined as a pre-determined set of instructions monitoring an electroplating cell to determine whether the electroplating bath is of sufficiently good quality. Disclosed embodiments allow the sensitivity sufficient to create a go/no-go test to determine the quality of the plating bath and prevent wafer scrap due to continued plating in a degraded bath.

As described herein, disclosed embodiments may be recipe-centered. An electroplating recipe is a set of instructions including parameters that a tool or apparatus uses to plate a substrate. Unlike conventional methods of monitoring plating baths, which are hardware-centered, disclosed embodiments utilize parameters tied to recipes to allow monitoring of the same type of substrate plated in different cells, as well as different types of substrates to be plated in the same cell. As a result, disclosed embodiments may be independent of substrate type such that control limits or baseline parameters for a plating cell are not updated each time a different type of substrate is processed in the plating cell. Examples of parameters specified in a plating recipe include plating substrate conditions (e.g., substrate size, seed layer composition or sheet resistance, and pattern properties such as recess density, dimensions), electrolyte properties (e.g., composition, ionic conductivity, and additive package), and applied current and voltage (e.g., applied current level between the substrate and anode, duration of the applied current, and current applied by an auxiliary electrode). Each recipe has its own drift(s), fault range(s), etc. that characterize the metrology process for that algorithm.

Figure 5:
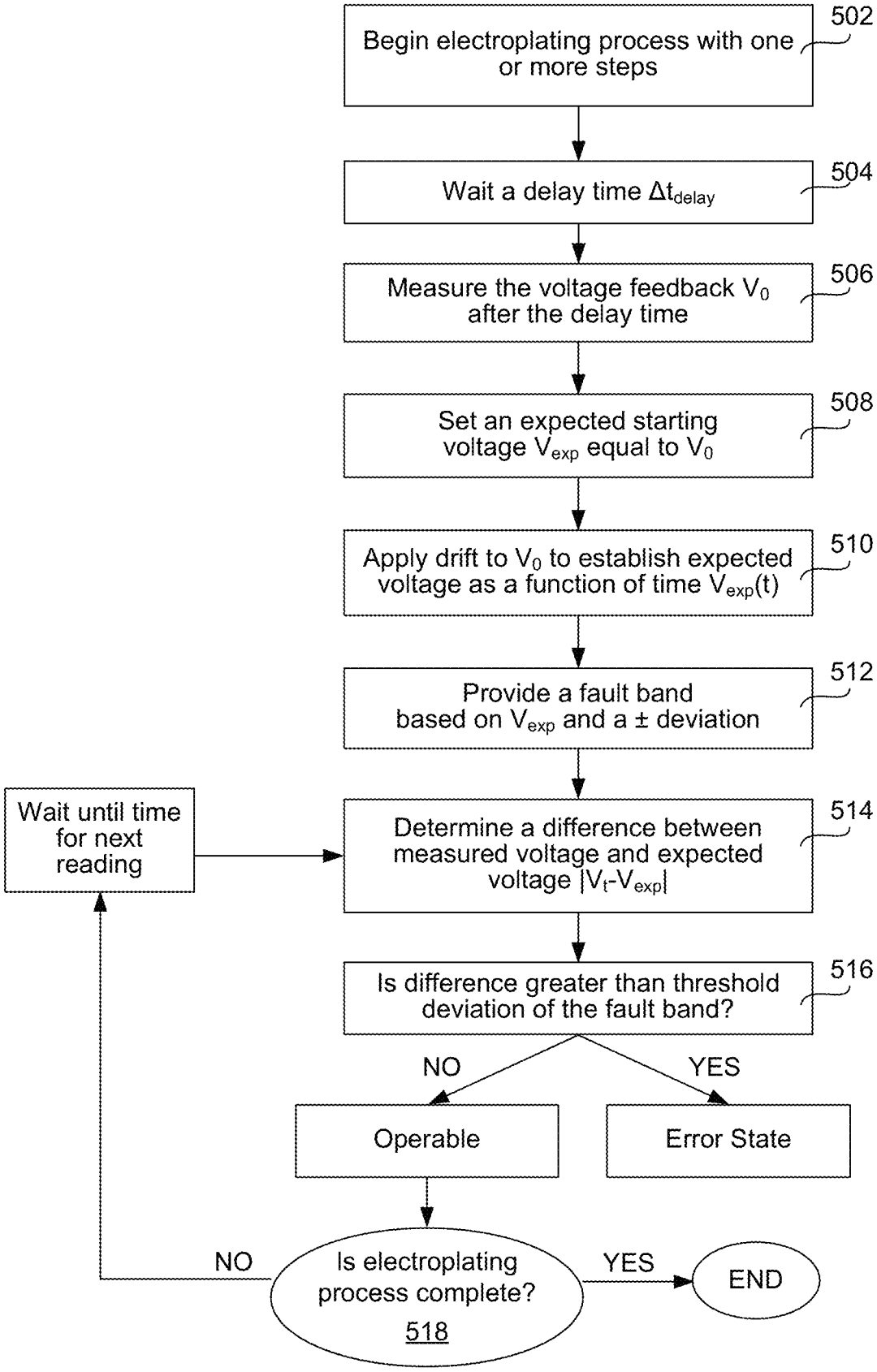
FIG. 5 is a process flow diagram depicting operations performed in accordance with disclosed embodiments.

FIG. 5 is a process flow diagram depicting operations for performing a method in accordance with disclosed embodiments. In operation 502, an electroplating process begins. The process is performed in one or more steps, e.g., a process may be performed in n steps. An expected voltage profile of higher complexity may be generated by dividing the process into a multi-step process having more steps. More steps enable finer resolution.

A step may be defined as a pre-determined duration of time during which current is constant. In some cases, consecutive steps (i.e., steps one right after another) performed at the same current may be treated as two or more steps. The nth step as used herein begins at a time $t_{n-1}$ and ends at a time $t_n$. The duration of the nth step is determined by:

$$\text{Duration of the } n\text{th Step} = t_n - t_{n-1} \tag{1}$$

Figure 6A:
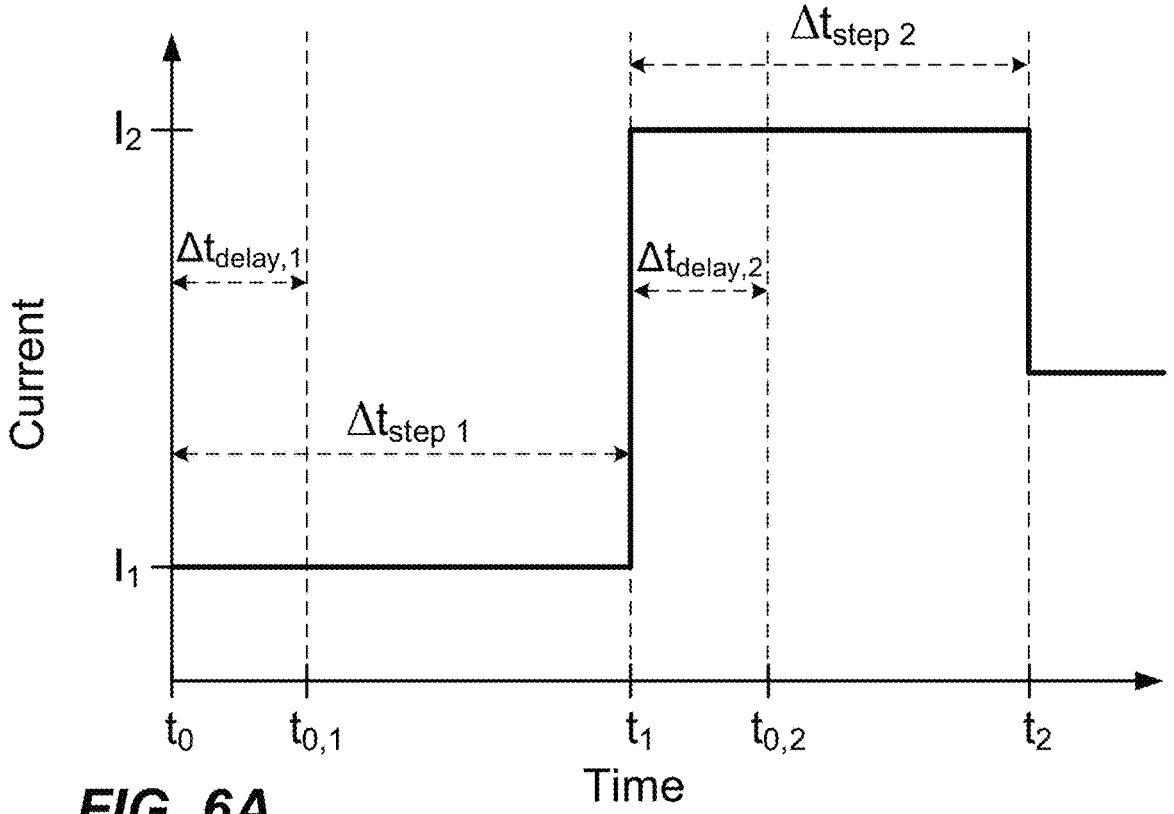
FIG. 6A is an example graph of current for a multi-step electroplating process in accordance with disclosed embodiments.

FIG. 6A shows current over time for two steps and a partial third step. Here, $t_0$ is the time at which electroplating for the first step starts. At $t_1$, the electroplating stops for the first step. The duration of the first step is determined by:

$$\Delta t_{step\ 1} = t_1 - t_0 \tag{2a}$$

Note that during the first step, current is constant at $I_1$.

A second step is also depicted in FIG. 6A. In the second step, $t_1$ is the time electroplating starts, and $t_2$ is the time electroplating stops. The duration of the second step may be determined by:

$$\Delta t_{step\ 2} = t_2 - t_1 \tag{2b}$$

Note that during the second step, current is constant at $I_2$. As shown, current $I_2$ is different than current $I_1$ but as previously mentioned, in some embodiments, current $I_2$ may be equal to current $I_1$, even if the process is treated as two different steps.

The time lapsed in a step may be measured by a step portion, which is defined as a fraction of the electroplating step completed at a certain time. During a step, the step portion represents how much of the plating process has been performed at that time. A step portion for the nth step at time t may be determined by:

$$\text{Step Portion} = \frac{t - t_{n-1}}{t_n - t_{n-1}} \tag{3}$$

Figure 6B:
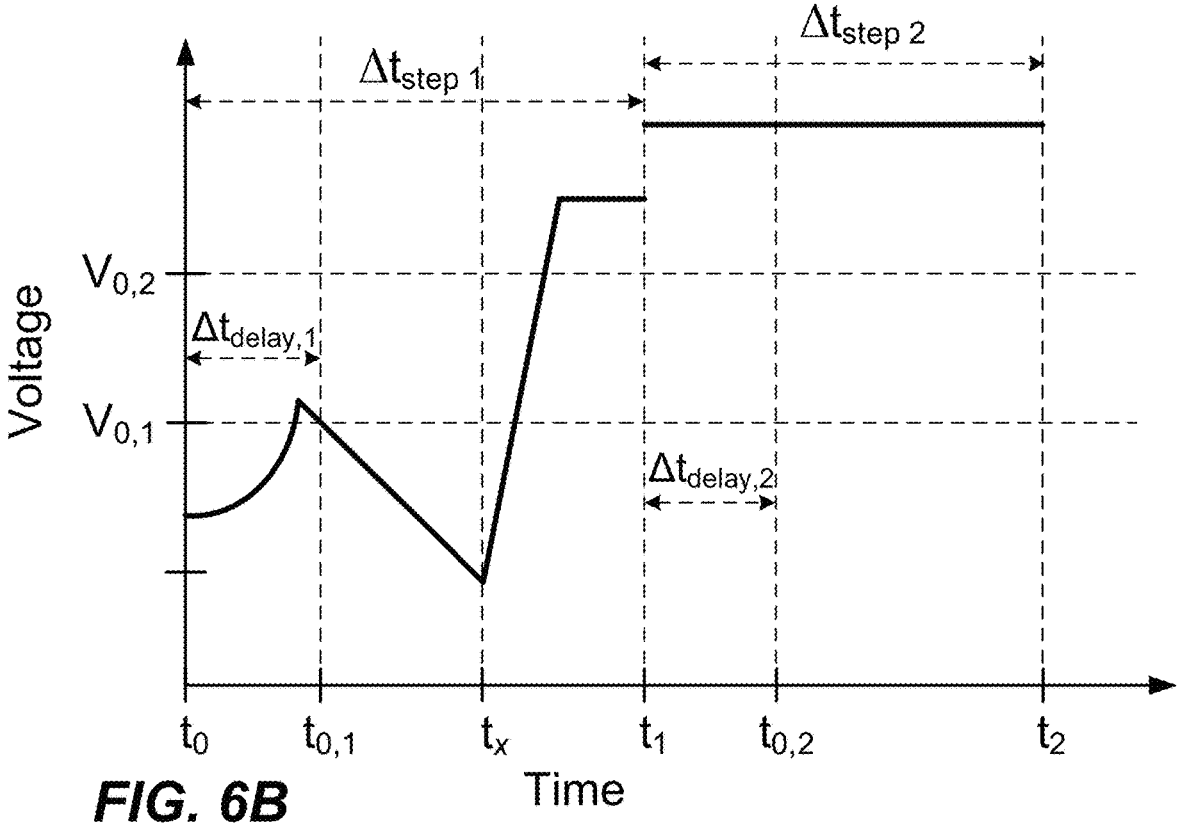
FIG. 6B is an example graph of voltage readings for a multi-step electroplating process in accordance with disclosed embodiments.

In certain disclosed embodiments, voltage of the electroplating cell at a given time depends on the step portion (e.g., how much of the plating process has been performed in a given step). In FIG. 6B, an example voltage curve is depicted with measured voltage readings over time t. At $t_0$, electroplating begins for the first step. Note the voltage drops over time. The increase at time $t_x$ towards the end of the first step is an example of the voltage increase that occurs in an electroplating process step to maintain the same constant current when a via is almost completely filled (that is, where the electroplating rate decreases due to the suppressor and its leveling character overwhelming the accelerator as the features are nearly completely filled). At time $t_1$, the first electroplating step is completed and the second electroplating step begins. In an electroplating process with two or more steps, monitoring may pause and resume after a user-specified delay period ($\Delta t_{delay,\ 2}$). Thus, in some embodiments, the electroplating process for the (n+1)th step may begin at a time shortly after $t_n$.

Returning to FIG. 5, in operation 504, certain disclosed embodiments involve waiting a delay period $\Delta t_{delay}$. When a power supply begins delivering current to the cell's electrodes, it might take some time for the power supply to power the electroplating cell with the corresponding voltage and for the voltage to stabilize. A delay period may be implemented to allow the voltage to stabilize before reading voltage on the electroplating cell, thereby improving reliability in the system. Waiting a delay period ensures that the voltage measured is for the current implemented during the step before the system begins monitoring voltage.

In some embodiments, the delay period $\Delta t_{delay}$ varies from step to step. For example, $\Delta t_{delay}$ may be specified at the beginning of a multi-step electroplating process and at the beginning of each step. In some embodiments, the delay period is the same from step to step. The delay period may be between about 2 seconds and about 500 seconds, for example about 300 seconds. The delay period in the nth step may be indicated by the difference between the time at which voltage readings begin $t_0$ and the time at which electroplating begins $t_{n-1}$, such that the delay period for the nth step is determined by:

$$\Delta t_{delay,n} = t_{0,n} - t_{n-1} \tag{4}$$

In FIG. 6A, the delay period for the first step is shown at $t_{0,1}$ and the delay period for the second step is shown at $t_{0,2}$. Since the current is constant during a single step, the current at the delay period $\Delta t_{delay,n}$ is equal to the current during the duration nth step as shown in FIG. 6A.

In FIG. 6B, a delay period $\Delta t_{delay,1}$ for the first step is shown at $t_{0,1}$. Note the unstable voltage reading between $t_0$ and $t_{0,1}$ is exaggerated to show that while electroplating begins at $t_0$, the voltage readings are not considered until $t_{0,1}$. Likewise, a delay period $\Delta t_{delay}$ for the second step is shown between the time where electroplating begins $t_1$ and the time where the voltage readings begin $t_{0,2}$. Note that although the voltage curve depicted in FIG. 6B shows a discontinuity at time $t_1$ (the end of step 1, or the beginning of step 2), an actual measured voltage curve is continuous. For purposes of FIG. 6B, delay period $\Delta t_{delay,2}$ for the second step is the same as delay period $\Delta t_{delay,1}$ for the first step, but in various embodiments, delay period $\Delta t_{delay}$ may vary from step to step.

Returning to FIG. 5, in operation 506, an initial voltage reading is measured after the delay period $\Delta t_{delay}$. As shown in FIG. 6B, the voltage $V_{0,1}$ is the voltage reading measured for the first step after the delay period $\Delta t_{delay,1}$ has lapsed (e.g., $V_{0,1}$ is the voltage reading at time $t_{0,1}$) Likewise, in the second step, voltage $V_{0,2}$ is the voltage reading measured for the second step after the delay period $\Delta t_{delay,2}$ (e.g., $V_{0,2}$ is the voltage reading at time $t_{0,2}$).

In operation 508, an expected starting voltage $V_{exp}$ is set equal to $V_{0,1}$. This effectively sets a baseline against which the variations in voltage readings are measured. For the reasons set forth above, different cells operating in the same state may have different values of starting voltage. Setting the initial voltage for each step of each cell, allows monitoring to proceed without concern about different internal resistances of different cells. In operation 510, a drift D is applied to $V_0$ to establish expected voltage as a function of time $V_{exp}(t)$. Drift may be defined as the total change of the expected voltage during the electroplating process in a given step. The extent of drift may be determined by empirical data obtained from prior electroplating processes on electroplating cells. A drift profile includes (i) a gradual reduction in voltage, and (ii) a rapid increase in voltage, and (iii) a period of stable voltage. Expected voltage as a function of time for the nth step may be determined by:

$$V_{exp,step\ n}(t) = V_0 + (\text{step portion} \times D) = V_0 + \left(\frac{t - t_{n-1}}{t_n - t_{n-1}}\right) \times D \quad (5)$$

In Equation 5, the voltage reading at time t is $V_{exp,\ step\ n}(t)$. $V_0$ is the voltage reading measured at the start of monitoring (e.g., after the delay period $\Delta t_{delay}$), $t_{n-1}$ the time at which electroplating for the nth step begins, $t_n$ is the time at which the nth step ends and when electroplating for the nth step concludes, and D is drift. Drift parameters (e.g., the amount of the drift and the delay time) may be determined using voltage readings observed during plating of substrates known to be good substrates. Good substrates may be identified as those having satisfactory electroplating results such as physical and electrical properties that are within specifications. In addition, these substrates may be identified using cross-sections of FIB-SEM, post-CMP defect review, and x-ray imaging. In various embodiments, drift parameters are approximated by determining linear fragments of expected voltage for plating processes or subprocesses such as those shown in FIG. 6B. Fault bands may also be approximated using the voltage profiles of plating processes for good substrates. As further described below, a "golden wafer profile" of expected voltages may be created using voltage readings at specific times or by taking the derivative of expected voltage readings at specific times. A "golden wafer profile" is a profile created from normalized profiles such that the profile may be used in a wide variety of electroplating cells, regardless of the cell's specific internal resistance.

In a multi-step process, a specified drift may be applied to each step to assemble segments of the function $V_{exp}(t)$ into a desired profile. Additionally, in a multi-step process, the beginning of each step may restart monitoring such that the expected voltage is set equal to the voltage reading plus the difference between the expected voltage and the voltage reading at the end of the previous process step.

For example, as shown in FIG. 6B, the beginning of the second step may restart monitoring. This allows the expected voltage in the second step to adapt to a change in the plating current. The expected voltage $V_{exp}$ for the second step may be determined by:

$$V_{exp} = V_{0,2} + (V_{exp}(t_1) - V(t_1)) \quad (6)$$

In Equation 6, $V_{exp}(t_1)$ represents the expected voltage (not shown in FIG. 6B) at the end of step 1, whereas $V(t_1)$ represents the measured voltage (shown as the lower curve at time $t_1$ in FIG. 6B) at the end of step 1. This equation accounts for the voltage reading at the end of step 1 to determine the expected voltage $V_{exp}$ during step 2. In operation 512, a fault band is provided based on $V_{exp}$ and a ±deviation. A fault band may be defined as a range of allowed voltages. The maximum and minimum allowed voltages in a fault band constitute the threshold deviation of voltage. The threshold deviation may be a percentage (such as ±10%) or may be absolute (such as ±0.01V).

In certain embodiments, the threshold deviation is about ±20% of the expected voltage reading at any given time t. In some cases, the threshold deviation is about ±10% of the expected voltage reading or about ±5% of the expected voltage reading. The fault band may vary within a step, and may vary from step to step. For example, the threshold deviation during the expected increase in voltage (such as at time $t_x$ as shown in FIG. 6B) when a via is almost completely filled may be greater than ±10%, while the threshold deviation during the rest of the step may be about ±10%. The threshold deviation of the fault band may be determined by:

$$\text{Threshold Deviation} = V_{exp}(t) \pm (\text{Deviation Percent} \times V_{exp}(t)) \quad (7a)$$

For example, a threshold deviation of ±10% of the fault band may be determined by:

$$\text{Threshold Deviation} = V_{exp}(t) \pm (0.10 \times V_{exp}(t)) \quad (7b)$$

In operation 514, the actual measured voltage $V_t$ is read, and a difference between the measured voltage $V_t$ at time t and the expected voltage $V_{exp}$ is determined by:

$$\text{Difference} = |V_t - V_{exp}(t)| \quad (8)$$

In operation 516, it is determined whether the difference in operation 514 is greater than the threshold deviation of the fault band. If the difference is greater than the threshold deviation of the fault band, then the electroplating cell is placed in an "error state." As a result, an electroplating cell placed in an "error state" indicates that no further substrates are processed in that electroplating bath.

If the difference is less than the threshold deviation of the fault band, then the electroplating cell is operable. It is then determined in operation 518 whether the electroplating process is complete. If so, the process ends. If not, then the system waits until time for the next voltage reading, at which time operations 514 and 516 are repeated. Operations 514, 516, and 518 are repeated until the electroplating process is complete.

As mentioned above, in various embodiments, a "golden wafer profile" is created for use in disclosed processes. A "golden wafer profile" may be established using voltage readings at specific times during an electroplating process, or may be established using the derivative of voltage readings at specific times during an electroplating process. These voltage readings are recorded and stored from prior plating processes that yielded good substrates.

For example, to establish a "golden wafer profile," the system may record and store voltage readings of an arbitrary number of good substrates at an arbitrary number of time points over the course of the plating process. The profile of each substrate may be normalized by subtracting the first recorded voltage from every subsequent recorded voltage and the "golden wafer profile" is created from the average of these normalized profiles. In this approach, the drift of a plating process or subprocess need not be linear. At any number of times during the process or subprocess, an average or mean voltage taken from multiple good substrates is used as the expected voltage for that time. During the plating of subsequent substrates, the voltage readings may be observed and normalized in the same fashion and the electroplating cell may be placed in an "error state" if the normalized voltage reading deviates from the golden profile by more than a specified limit. Fault bands may be created from the data obtained to produce the golden wafer profile. For example, the voltage readings will have a standard deviation, variance, and other statistical measures of distribution. Such measure can be used to set a fault band for each expected voltage at its corresponding time in the electroplating process.

In another example, a "golden wafer profile" may be created by averaging the derivatives of the voltage readings of known good substrates. The derivative of voltage readings of subsequent substrates may be compared to the golden profile and the electroplating cell may be placed in an "error state" if the derivative deviates from the golden profile by more than a specified limit.

In some embodiments where voltage instead of current is the process control parameter, readings of the current response are monitored in substantially the same manner as described elsewhere herein.

Apparatus

As noted above, FIG. 2 provides an example electroplating apparatus suitable for performing disclosed embodiments. Electroplating apparatus 201 includes a controller 247 for performing various operations. Controller 247 is an example of a controller that is used to control wafer rotation, flow rate of electroplating solution, temperatures and pressures, current, and other conditions. In some embodiments, each electroplating cell has its own controller.

The controller 247 will typically include one or more memory devices and one or more processors communicatively connected with various process control equipment, e.g., valves, wafer handling systems, etc., and configured to execute the instructions so that the apparatus will perform a technique in accordance with the disclosed embodiments, e.g., a technique such as that provided in the electroplating operations of FIG. 5. The processor may include a CPU or computer, analog, and/or digital input/output connections, stepper motor controller boards, etc. In certain embodiments, the controller controls all of the activities of the electroplating apparatus and/or of the pre-wetting chamber. Machine-readable media containing instructions for controlling process operations in accordance with the present disclosure may be coupled to the controller 247. The controller 247 may be communicatively connected with various hardware devices, e.g., mass flow controllers, valves, vacuum pumps, etc. to facilitate control of the various process parameters that are associated with the electroplating operations as described herein.

For example, the controller 247 may include instructions for performing electroplating and monitoring electroplating baths in accordance with any method described above or in the appended claims. Non-transitory machine-readable media containing instructions for controlling process operations in accordance with disclosed embodiments may be coupled to the system controller 247. Typically there will be a user interface associated with controller 247. The user interface may include a display screen, graphical software displays of the apparatus and/or process conditions, and user input devices such as pointing devices, keyboards, touch screens, microphones, etc. Compiled object code or script is executed by the processor to perform the tasks identified in the program. In some embodiments, the methods described herein will be implemented in a system which includes an electroplating apparatus and a stepper.

In some embodiments, a controller 247 may control all of the activities of the apparatus 201. The controller 247 may execute system control software stored in a mass storage device, loaded into a memory device, and executed on a processor. The processor may include a central processing unit (CPU) or computer, analog and/or digital input/output connections, stepper motor controller boards, and other like components. Instructions for implementing appropriate control operations are executed on the processor. These instructions may be stored on the memory devices associated with the controller 247 or they may be provided over a network. In certain embodiments, the controller 247 executes system control software.

The system control software may include instructions for measuring the voltage in the electroplating cell, controlling the flow rate of the plating solution, wafer movement, water transfer, etc., as well as instructions for controlling the mixture of plating solution including additives, the chamber and/or station pressure, the chamber and/or station temperature, the wafer temperature, the target current levels, the substrate support, chuck, and/or susceptor position, temperature of plating solution, and other parameters of a particular process performed by the apparatus 201. The system control software may be configured in any suitable way. For example, various process tool component subroutines or control objects may be written to control operation of the process tool components necessary to carry out various process tool processes. The system control software may be coded in any suitable computer readable programming language, for example, assembly language, C, C++, Pascal, Fortran, or others.

In some embodiments, system control software includes input/output control (IOC) sequencing instructions for controlling the various parameters described above. For example, one or more electroplating steps may include one or more instructions for execution by the controller 247. The instructions for reading voltage and determining whether the voltage readings are within the threshold deviation may be implemented on the controller 247, for example. In some embodiments, the recipe phases may be sequentially arranged, such that steps in a multi-step process are executed in a certain order for that process phase. For example, the controller 247 may include instructions for electroplating at two or more steps, each of which delivers a constant current to the electroplating cell.

Other computer software and/or programs may be employed in some embodiments. Examples of programs or sections of programs for this purpose include wafer positioning program, an electroplating bath composition control program, a pressure control program, and a heater control program.

In some implementations, the controller 247 is part of a system, which may be part of the above-described examples. Such systems can include semiconductor processing equipment, including a processing tool or tools, chamber or chambers, a platform or platforms for processing, and/or specific processing components (a wafer pedestal, an electroplating bath flow system, etc.). These systems may be integrated with electronics for controlling their operation before, during, and after processing of a semiconductor wafer or substrate. The electronics may be referred to as the "controller," which may control various components or subparts of the system or systems. The controller 247, depending on the processing requirements and/or the type of system, may be programmed to control any of the processes disclosed herein, including the delivery of electroplating solution, temperature settings (e.g., heating and/or cooling), pressure settings, vacuum settings, power settings, additive concentration settings, flow rate settings, wafer rotation settings, positional and operation settings, wafer transfers into and out of a tool and other transfer tools and/or load locks connected to or interfaced with a specific system.

Broadly speaking, the controller 247 may be defined as electronics having various integrated circuits, logic, memory, and/or software that receive instructions, issue instructions, control operations, enable electroplating operations, enable voltage measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller 247 in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a substrate.

The controller 247, in some implementations, may be a part of or coupled to a computer that is integrated with, coupled to the system, otherwise networked to the system, or a combination thereof. For example, the controller 247 may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. For example, the computer may generate expected voltage curves and fault bands in accordance with disclosed embodiments. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller 247 receives instructions in the form of data, which specify parameters for each of the processing steps to be performed during one or more operations. It should be understood that the parameters may be specific to the type of process to be performed and the type of tool that the controller 247 is configured to interface with or control. Thus as described above, the controller 247 may be distributed, such as by including one or more discrete controllers that are networked together and working towards a common purpose, such as the processes and controls described herein. An example of a distributed controller 247 for such purposes would be one or more integrated circuits on a chamber in communication with one or more integrated circuits located remotely (such as at the platform level or as part of a remote computer) that combine to control a process on the chamber.

Without limitation, example systems may include a metal plating chamber or module, a plasma etch chamber or module, a deposition chamber or module, a spin-rinse chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller 247 might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

In some embodiments, there may be a user interface associated with controller 247. The user interface may include a display screen, graphical software displays of the apparatus and/or process conditions, and user input devices such as pointing devices, keyboards, touch screens, microphones, etc.

Signals for monitoring the process may be provided by analog and/or digital input connections of controller 247 from various process tool sensors. The signals for controlling the process may be output on the analog and digital output connections of the process tool. Non-limiting examples of process tool sensors that may be monitored include mass flow controllers, pressure sensors (such as manometers), thermocouples, etc. Appropriately programmed feedback and control algorithms may be used with data from these sensors to maintain process conditions.

EXPERIMENTAL

Experiment 1

Figure 7A:
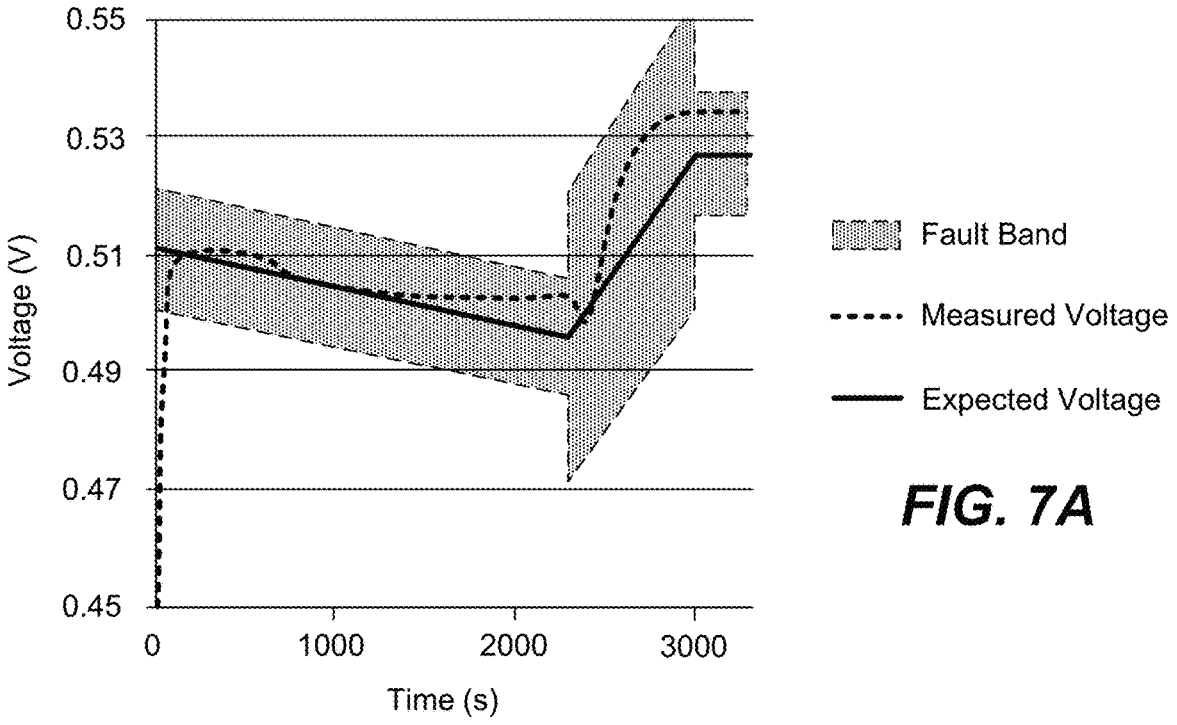
FIGS. 7A-7C are graphs of voltage readings for good electroplating baths and fault bands in accordance with disclosed embodiments.
Figure 7B:
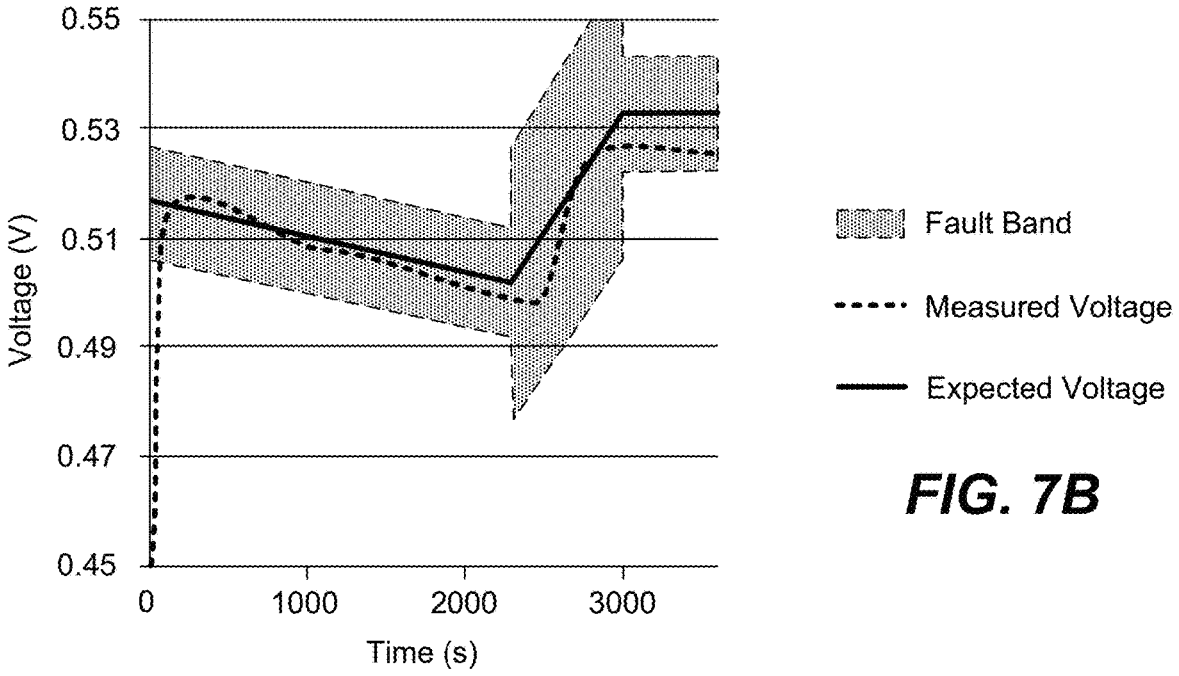
Figure 7C:
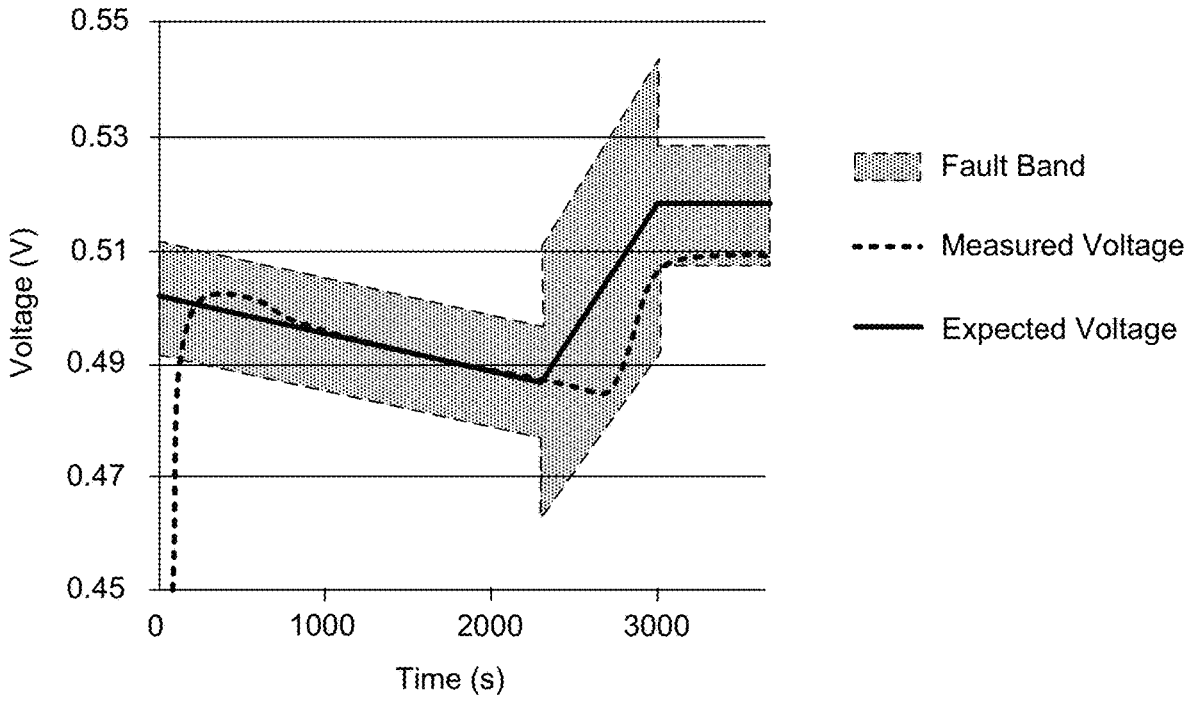
Figure 8A:
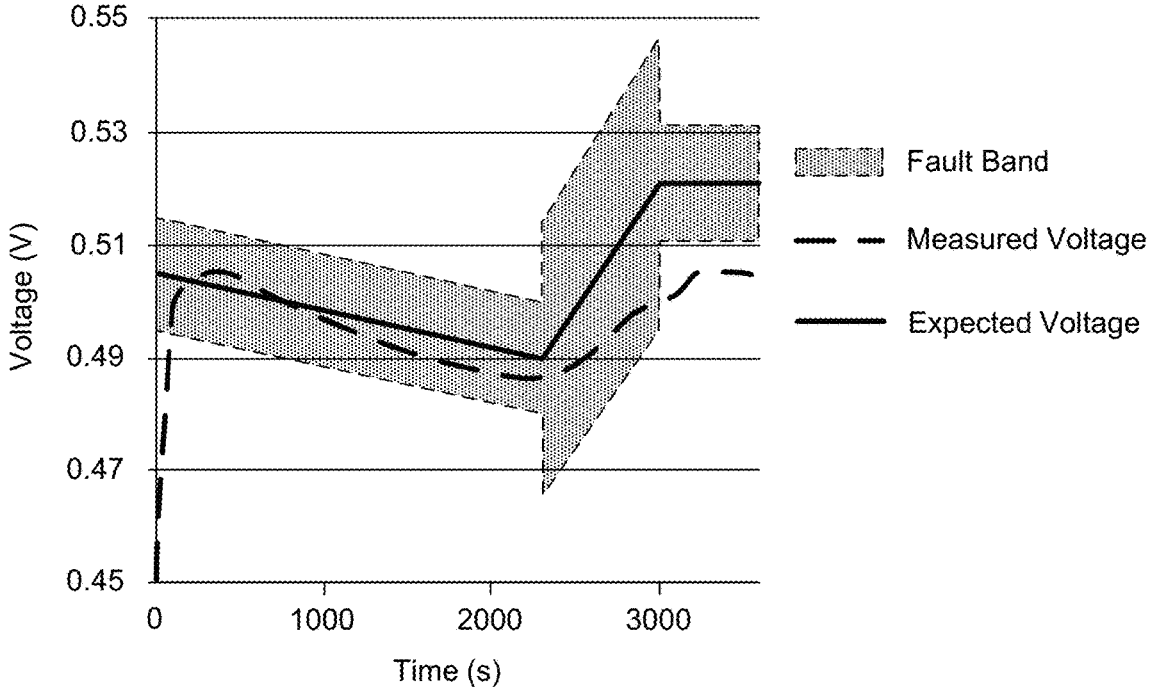
FIGS. 8A-8D are graphs of voltage readings for poor electroplating baths and fault bands in accordance with disclosed embodiments.
Figure 8B:
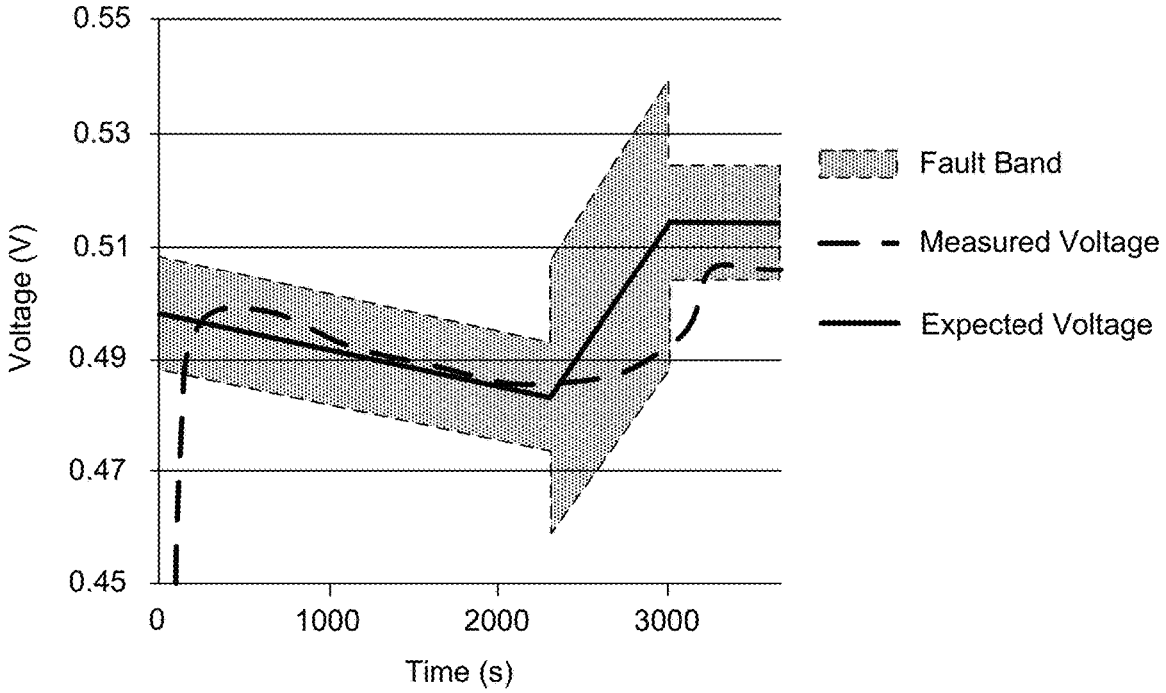
Figure 8C:
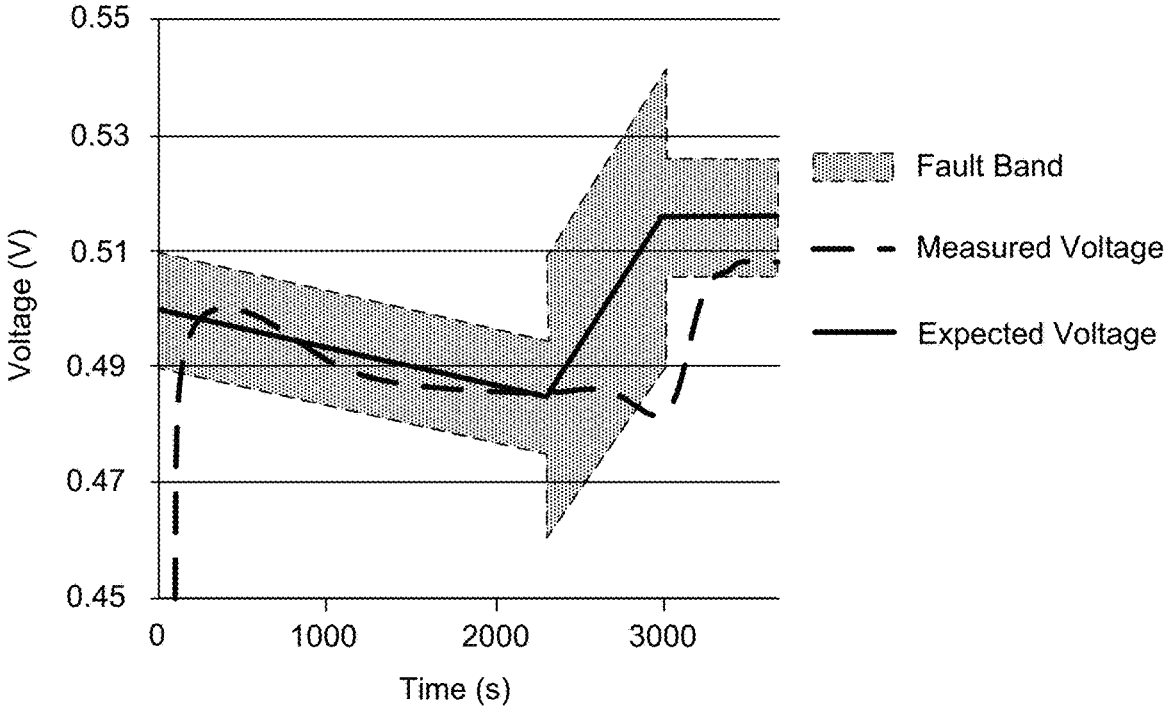
Figure 8D:
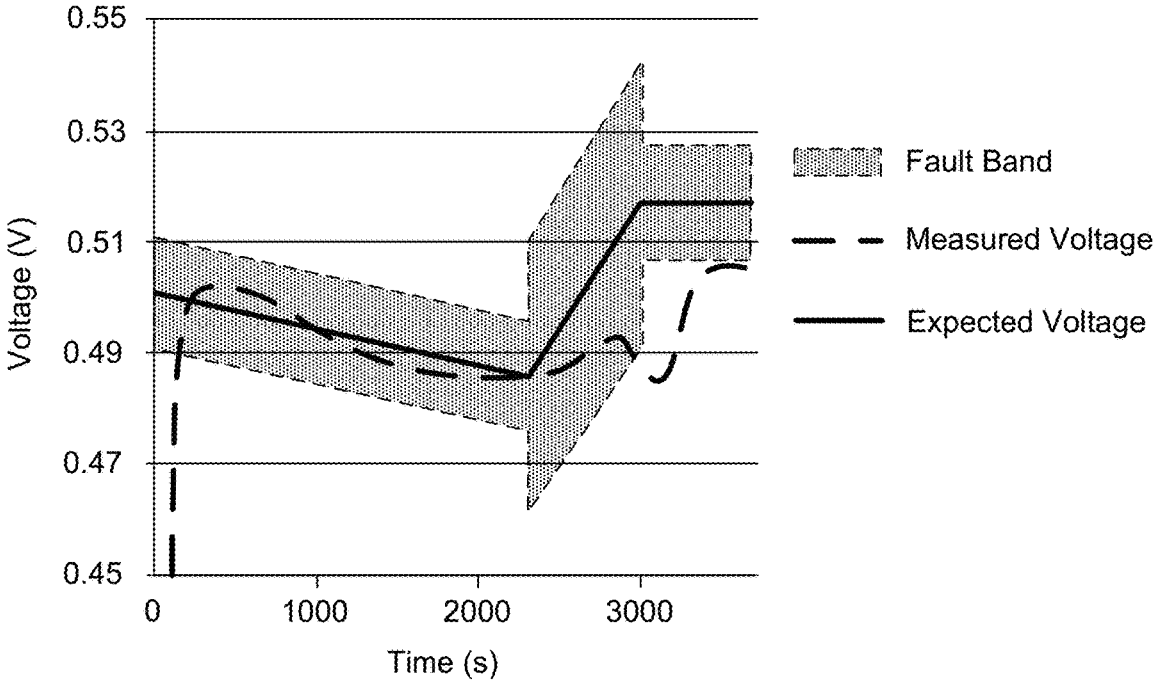

Example graphs depicting measured and expected voltages of various electroplating processes are provided in FIGS. 7A-7C and 8A-8D. FIGS. 7A-7C are voltage readings from electroplating processes in good electroplating baths, such that the electroplating cell was not placed in an error state. FIGS. 7A-7C each show a three-step electroplating process where the current setpoint was the same across all three steps. In FIGS. 7A-7C, the expected voltage, as indicated by the solid black line, is determined according to Equation 5. The fault band, as shown in the shaded band, extends above and below the solid black line to the threshold deviation. Note that during an increase in the expected voltage in the second step (between about 2200 seconds and about 3000 seconds), the fault band is larger than the fault band during the first and third steps. As previously discussed, different sized fault bands may be used to accommodate the expected deviations during a time in a step where a via is almost filled and the leveling character of additives is implemented and a higher voltage is used to generate the same constant current to the electroplating cell. There is some uncertainty in the timing of the transition from negative drift to positive drift during bottom-up fill, and some uncertainty regarding the slope of the positive drift. As a result, the fault band during the expected increase in voltage may be greater than the fault band during the rest of the step. In all of FIGS. 7A-7C, the electroplating baths constituted good baths, and the disclosed embodiments performed accurately categorized these three processes as being in an operable electroplating bath (e.g., not placed in an error state).

FIGS. 8A-8D are voltage readings from electroplating processes in poor electroplating baths, such that the difference determined in operation 514 of FIG. 5 is greater than the threshold deviation as determined in operation 516, thereby placing the electroplating bath in an "error" state.

CONCLUSION

Although the foregoing embodiments have been described in some detail for purposes of clarity of understanding, it will be apparent that certain changes and modifications may be practiced within the scope of the appended claims. It should be noted that there are many alternative ways of implementing the processes, systems, and apparatus of the present embodiments. Accordingly, the present embodiments are to be considered as illustrative and not restrictive, and the embodiments are not to be limited to the details given herein.

What is claimed is:

1. A method of controlling an electroplating cell by monitoring conditions of an electroplating bath, the method comprising:

(a) providing a substrate to an electroplating apparatus for electrodepositing a metal from the electroplating bath, the electroplating apparatus comprising the electroplating cell configured to hold the electroplating bath, a power supply, and a second electrode;

(b) electroplating the metal onto the substrate in the electroplating cell;

(c) waiting a delay period during the electroplating before reading an initial voltage between the substrate as a first electrode and the second electrode, wherein waiting the delay period during the electroplating before reading the initial voltage between the substrate as the first electrode and the second electrode is performed after beginning to electroplate the metal onto the substrate;

(d) reading the initial voltage between the substrate as the first electrode and the second electrode;

(e) during electroplating on the substrate in the electroplating cell, repeatedly reading a voltage between the first electrode and the second electrode;

(f) comparing each of the repeated readings of the voltage to a corresponding expected voltage that drifts from the initial voltage during the electroplating, wherein the drift is determined from substrate electroplating operations that produce satisfactory electroplating results;

(g) determining that one or more of the repeated readings of the voltage deviate from the corresponding expected voltage by a value greater than a threshold deviation; and (h) in response to determining that the one or more of the repeated readings of the voltage deviate from the corresponding expected voltage by a value greater than the threshold deviation, sending a notification to place the electroplating bath in an error state and/or suspending operation of the electroplating cell.

2. The method of claim 1, wherein suspending the operation of the electroplating cell is determined only in response to determining that the one or more repeated readings of the voltage deviate from the corresponding expected voltage by a value greater than the threshold deviation in (g).

3. The method of claim 1, further comprising prior to comparing each of the repeated readings of the voltage, setting an expected starting voltage equal to the initial voltage between the substrate and the second electrode.

4. The method of claim 1, wherein determining whether to suspend the operation of the electroplating cell in (g) comprises comparing each of the repeated readings to normalized voltage readings for one or more substrates determined to have the satisfactory electroplating results.

5. The method of claim 1, further comprising:

determining the corresponding expected voltage by adding the initial voltage to a drift parameter that varies during the electroplating, wherein the initial voltage between the substrate and the second electrode is read before repeatedly reading the voltage between the substrate and the second electrode, wherein the drift parameter is independent of the total magnitude of the repeated readings of voltage between the substrate and the second electrode, and wherein the drift parameter corresponds to the drift determined from substrate electroplating operations that produce satisfactory electroplating results.

6. The method of claim 1, wherein the drift comprises linear fragments modeled from voltage readings obtained for one or more substrates determined to have the satisfactory electroplating results.

7. The method of claim 1, wherein the expected voltage comprises normalized voltage readings for one or more substrates determined to have the satisfactory electroplating results.

8. The method of claim 1, wherein comparing each of the repeated readings of the voltage to the corresponding expected voltage that drifts from the initial voltage during the electroplating comprises taking one or more derivatives of the repeated readings of the voltage and comparing said derivatives to one or more averaged derivatives of corresponding voltage readings for one or more substrates determined to have the satisfactory electroplating results.

9. The method of claim 1, wherein the second electrode is an anode.

10. The method of claim 1, wherein the second electrode is a reference electrode in proximity to the substrate.

11. The method of claim 1, wherein the electroplating cell is coupled to the power supply controlled to make the repeated readings of voltage between the substrate and the second electrode.

12. The method of claim 1, wherein the substrate comprises recessed features, and the electroplating on the substrate comprises depositing a metal layer on the substrate in a manner that preferentially fills the recessed features.

13. The method of claim 1, wherein all of one or more of the repeated readings of the voltage are read while applying a constant current between the substrate and the second electrode.

14. The method of claim 1, wherein the drift is a linear or logarithmic function of time.

15. The method of claim 1, wherein the electroplating comprises one or more steps of electroplating, and wherein a constant current is applied in each of the one or more steps.

16. The method of claim 1, wherein the expected voltage is determined by adding the initial voltage to a drift parameter which is independent of the total magnitude of the repeated readings of voltage.

* * * * *